US006926568B2

(12) United States Patent
Mizuguchi et al.

(10) Patent No.: US 6,926,568 B2
(45) Date of Patent: Aug. 9, 2005

(54) OUTBOARD MOTOR STEERING SYSTEM

(75) Inventors: Hiroshi Mizuguchi, Wako (JP); Hideaki Takada, Wako (JP); Hiroshi Watabe, Wako (JP); Taiichi Otobe, Wako (JP); Yoshinori Masubuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 49 days.

(21) Appl. No.: 10/732,464

(22) Filed: Dec. 11, 2003

(65) Prior Publication Data

US 2004/0121665 A1 Jun. 24, 2004

(30) Foreign Application Priority Data

Dec. 16, 2002 (JP) ..... 2002-363828
Dec. 16, 2002 (JP) ..... 2002-363829
Dec. 16, 2002 (JP) ..... 2002-363830
Dec. 16, 2002 (JP) ..... 2002-363831
Dec. 16, 2002 (JP) ..... 2002-363832

(51) Int. Cl.[7] ..... B63H 5/125
(52) U.S. Cl. ..... 440/615
(58) Field of Search ..... 440/61 R, 615, 440/900, 53, 61 C, 57; 114/144 R, 150

(56) References Cited

U.S. PATENT DOCUMENTS 3,250,240 A * 5/1966 Ziegler ..... 440/6
4,416,637 A * 11/1983 Kashmerick et al. ..... 440/60
4,698,035 A * 10/1987 Ferguson ..... 440/61 R

FOREIGN PATENT DOCUMENTS

JP 62-125996 6/1987

* cited by examiner

*Primary Examiner*—Ed Swinehart
(74) *Attorney, Agent, or Firm*—Westerman, Hattori, Daniels & Adrian, LLP

(57) ABSTRACT

An outboard motor steering system for an outboard motor mounted on a stern of a boat and having an internal combustion engine at its upper portion and a propeller with a rudder at its lower portion that is powered by the engine to propel and steer the boat, having a swivel shaft connected to the propeller to turn the propeller relative to the boat and housed in a swivel case, a hydraulic actuator such as a double-acting cylinder connected to the swivel shaft to rotate the swivel shaft, a hydraulic pressure supplier connected to the hydraulic actuator to supply hydraulic pressure, and a controller that controls supply of the hydraulic pressure to the hydraulic actuator in response to a steering signal inputted by an operator such that the outboard motor is steered relative to the boat. In the system, the hydraulic actuator and the hydraulic pressure supplier are housed in the swivel case. The system is thus simply configured to avoid increase in number of components and weight, and does not cause a problem regarding space utilization and operation efficiency, while improving steering feel.

20 Claims, 20 Drawing Sheets

OUTBOARD MOTOR STEERING SYSTEM

BACKGROUND OF THE INVENTION

1. Field of the Invention

This invention relates to an outboard motor steering system.

2. Description of the Related Art

In outboard motor steering systems, an add-on mechanism constituted as a separate unit from the outboard motor and used to power-assist the turning of the tiller handle is known. For example, as taught in Japanese Laid-Open Patent Application Sho 62 (1987)-125996, this mechanism typically includes an actuator such as a steering hydraulic (oil) cylinder whose driving end (piston rod head) is connected to the tiller handle through an arm or the like, and a hydraulic pump that is connected to the steering mechanism to operate in response to the angle of steering. The hydraulic cylinder is connected to the hydraulic pump by a hydraulic hose or pipe attached to the boat (hull) to be supplied with pressurized oil from the pump such that the steering of the tiller handle by human power to turn the rudder is power-assisted.

The add-on steering system constituted as a separate unit from the onboard motor has disadvantages, most notably that its structure is complicated, that it adds to the number and weight of the components, it degrades operation efficiency in fabrication or maintenance, and that it takes up space between the front of the outboard motor and the stern (rear) of the boat to fasten the hydraulic actuator and the arm, etc. In addition, the add-on steering system is disadvantageous, since the system includes many connecting parts, it tends to have an unpleasant steering "feel" owing to, for instance, plays or poor steering response in the connecting parts.

SUMMARY OF THE INVENTION

An object of the present invention is therefore to overcome the foregoing issues by providing an outboard motor steering system that is simply configured to avoid increase in number of components and weight, and does not cause a problem regarding space utilization and operation efficiency, while improving steering feel.

In order to achieve the foregoing objects, this invention provides a steering system for an outboard motor mounted on a stern of a boat and having an internal combustion engine at its upper portion and a propeller with a rudder at its lower portion that is powered by the engine to propel and steer the boat, comprising: a swivel shaft connected to the propeller to turn the propeller relative to the boat; a swivel case that is fixed to the outboard motor and rotatably houses the swivel shaft; a hydraulic actuator that is connected to the swivel shaft to rotate the swivel shaft; a hydraulic pressure supplier that is connected to the hydraulic actuator to supply hydraulic pressure to the hydraulic actuator; and a controller that is connected to the hydraulic pressure supplier to control supply of the hydraulic pressure to the hydraulic actuator in response to a steering signal inputted by an operator such that the outboard motor is steered relative to the boat; wherein at least the hydraulic actuator and the hydraulic pressure supplier are housed in the swivel case.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor steering system according to a first embodiment of the present invention will now be explained with reference to the attached drawings.

Figure 1:
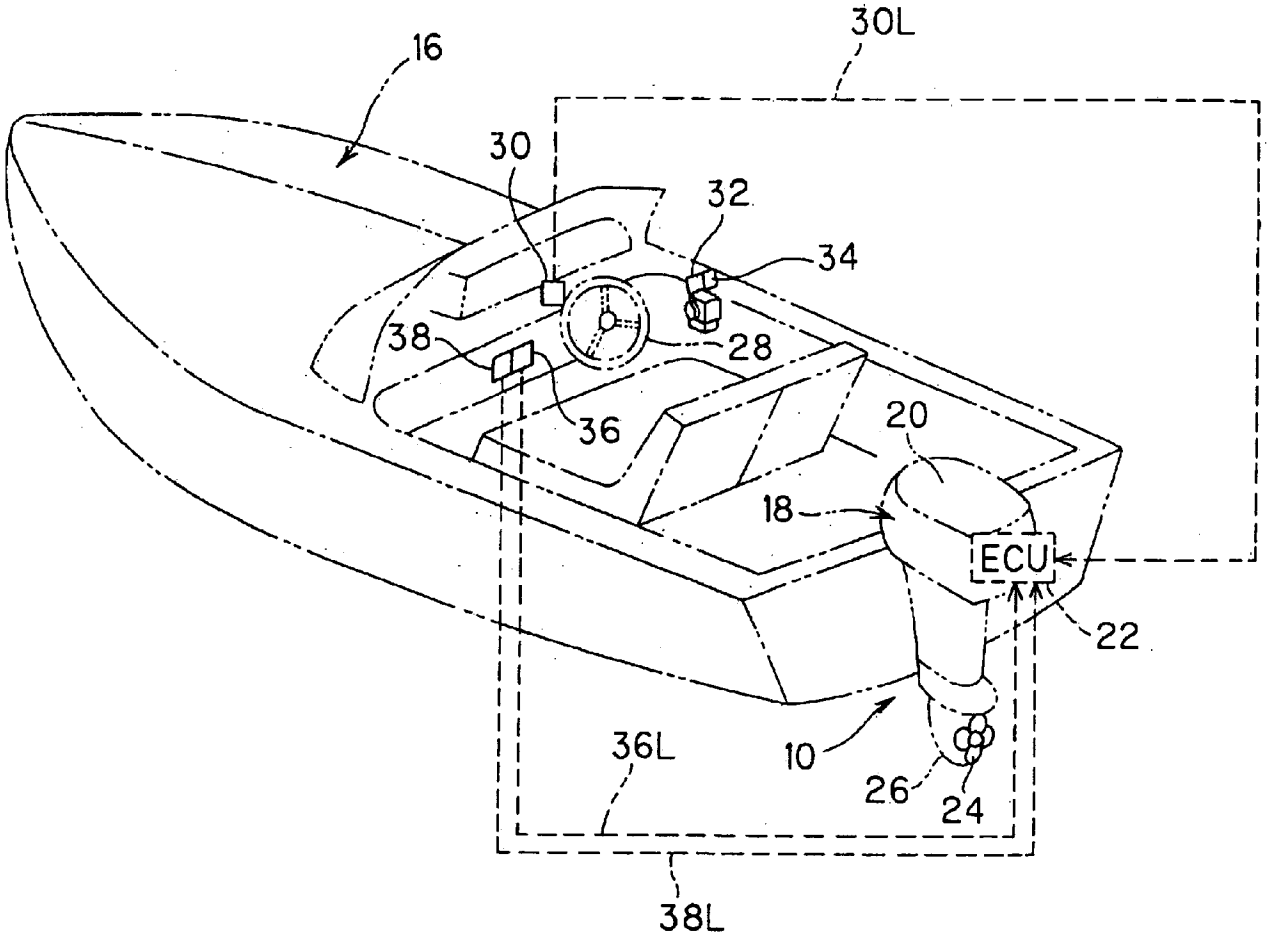
FIG. 1 is an overall schematic view of an outboard motor steering system according to a first embodiment of the invention.
Figure 2:
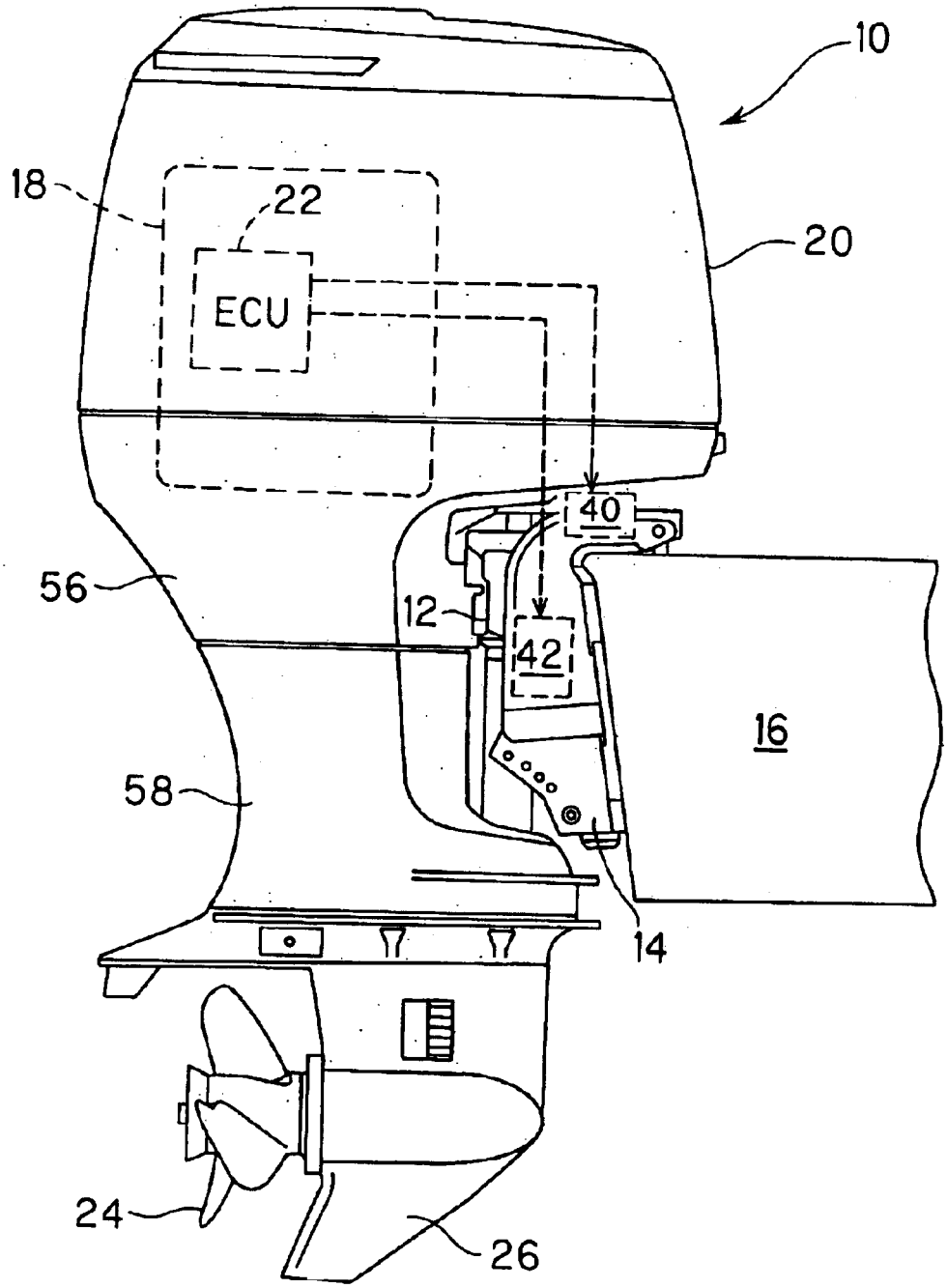
FIG. 2 is an explanatory side view of a part including an outboard motor of FIG. 1.

FIG. 1 is an overall schematic view of the outboard motor steering system, and FIG. 2 is an explanatory side view of a part including an outboard motor of FIG. 1.

Reference numeral 10 in FIGS. 1 and 2 designates an outboard motor built integrally of an internal combustion engine, propeller shaft, propeller and other components. As illustrated in FIG. 2, the outboard motor 10 is mounted on the stern of a boat (hull) 16 via a swivel case 12 (that houses a rotatable swivel shaft (not shown) and stern brackets 14, to be rotatable about the vertical and horizontal axes.

As shown in FIG. 2, the outboard motor 10 is equipped with an internal combustion engine 18 at its upper portion. The engine 18 is a spark-ignition, in-line four-cylinder gasoline engine with a displacement of 2,200 cc. The engine 18, located inside the outboard motor 10, is enclosed by an engine cover 20 and positioned above the water surface. An electronic control unit (ECU; controller) 22 constituted of a microcomputer is installed near the engine 18 enclosed by the engine cover 20.

The outboard motor 10 is equipped at its lower part with a propeller 24 and a rudder 26 adjacent thereto. The rudder 26 is fixed near the propeller 24 and does not rotate independently. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel 28 is installed near the operator's seat of the boat 16. A steering angle sensor 30 is installed near the steering wheel 28. The steering angle sensor 30 is made of a rotary encoder and outputs a signal in response to the turning of the steering wheel 28 by the operator. A throttle lever 32 and a shift lever 34 are mounted on the right side of the operator's seat. Operations inputted to these are transmitted to a throttle valve and the shift mechanism (neither shown) of the engine 18 through push-pull cables (not shown).

A power tilt switch 36 for regulating the tilt angle and a power trim switch 38 for regulating the trim angle of the outboard motor 10 are also installed near the operator's seat. These switches output signals in response to tilt-up/down and trim-up/down instructions inputted by the operator. The outputs of the steering angle sensor 30, power tilt switch 36 and power trim switch 38 are sent to the ECU 22 over signal lines 30L, 36L and 38L.

In response to the output of the steering angle sensor 30 sent over the signal line 30L, the ECU 22 operates an electric motor (not shown in FIGS. 1 and 2) to extend or contract a steering hydraulic cylinder (hydraulic actuator) 40 (shown in FIG. 2) so as to steer the outboard motor 10, i.e., change the direction of the propeller 24 and rudder 26, and thereby turn the boat 16 right or left. Specifically, the steering hydraulic cylinder 40 is a double-acting hydraulic cylinder. The hydraulic cylinder is hereinafter referred to as the "double-acting cylinder".

In response to the outputs of the power tilt switch 36 and power trim switch 38 sent over the signal lines 36L, 38L, the ECU 20 operates a conventional power tilt-trim unit 42 to regulate the tilt angle and trim angle of the outboard motor 10.

Figure 3:
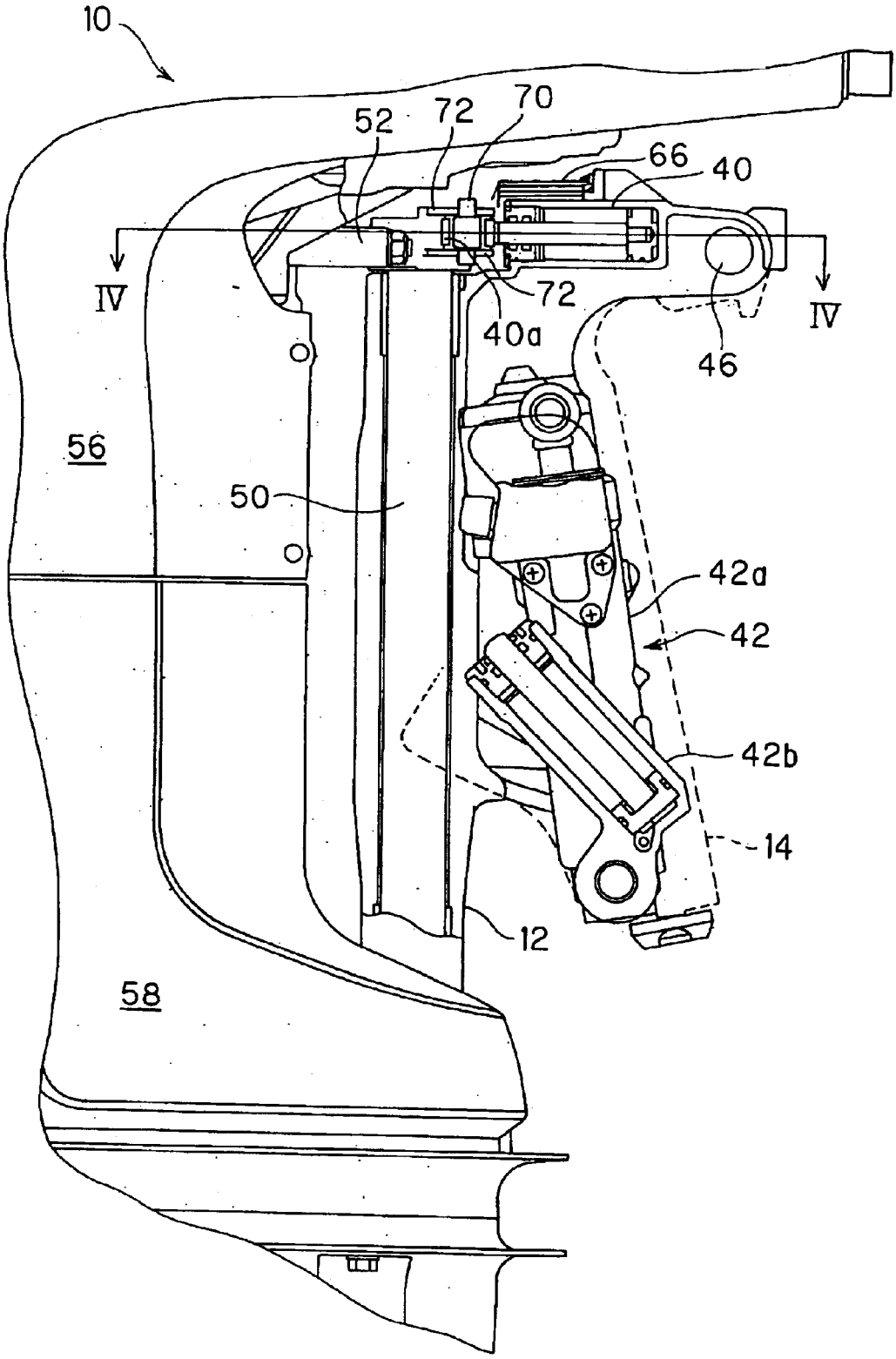
FIG. 3 is an enlarged explanatory side view of a part of FIG. 2.

FIG. 3 is an enlarged explanatory side view of FIG. 2 and showing the swivel case 12 of the outboard motor 10.

As illustrated in FIG. 3, the power tilt-trim unit 42 is equipped with one hydraulic cylinder 42*a* for trim angle regulation (hereinafter called the "tilt hydraulic cylinder") and, constituted integrally therewith, two hydraulic cylinders 42*b* for trim angle regulation (hereinafter called the "trim hydraulic cylinders"; only one shown). One end (cylinder bottom) of the tilt hydraulic cylinder 42*a* is fastened to the stern bracket 14 and through it to the boat 16 and the other end (piston rod head) thereof is fastened to the swivel case 12. One end (cylinder bottom) of each trim hydraulic cylinder 42*b* is fastened to the stern bracket 14 and through it to the boat 16, similarly to the one end of the tilt hydraulic cylinder 42*a,* and the other end (piston rod head) thereof abuts on the swivel case 12.

The swivel case 12 is connected to the stern bracket 14 through a tilting shaft 46 to be relatively displaceable about the tilting shaft 46. As mentioned above, the swivel shaft (now assigned with reference numeral 50) is rotatably accommodated inside the swivel case 12. The swivel shaft 50 has its upper end fastened to a mount frame 52 and its lower end fastened to a lower mount center housing (not shown). The mount frame 52 and lower mount center housing are fastened to a mount case 56 (on which the engine 18 is mounted) and an extension case 58.

Figure 4:
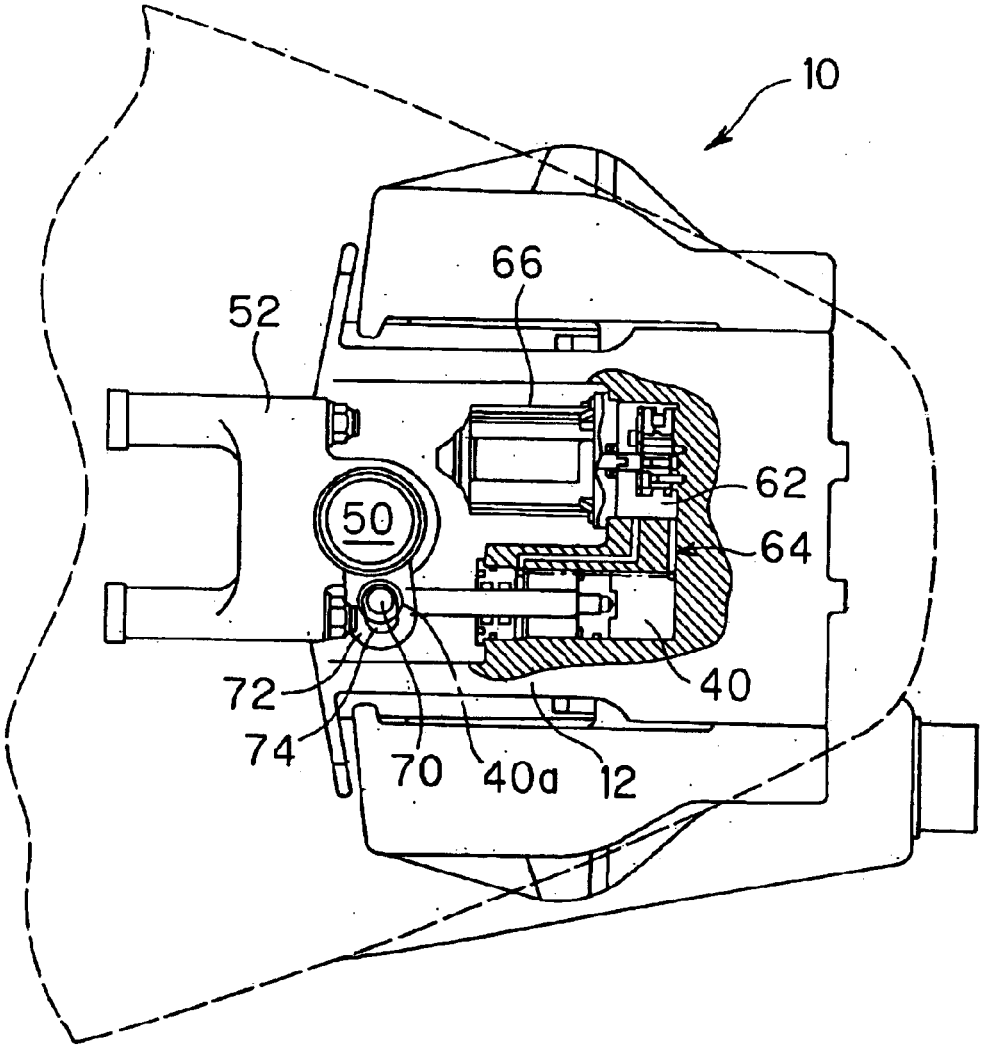
FIG. 4 is a cross-sectional view taken along the line IV—IV of FIG. 3.

FIG. 4 is a cross-sectional view taken along the line IV—IV of FIG. 3.

As illustrated in FIGS. 3 and 4, the swivel case 12 is enlarged at its upper portion where, in addition to the double-acting cylinder 40, hydraulic pressure supplier comprising a hydraulic pump 62 that supplies hydraulic pressure (pressurized oil) to the cylinder 40, and a hydraulic circuit 64 (partially shown) that connects the pump 62 to the cylinder 40 are housed and fixed thereto. The electric motor 66 is connected to the ECU 22 through harness (not shown in FIGS. 3 and 4).

As illustrated in FIG. 4, the double-acting cylinder 40 is installed in the swivel case 12 such that its longitudinal direction is in parallel with that of the electric motor 66. The driving end (piston rod head) 40*a* of the double-acting cylinder 40 is connected to a cylindrical member 70 that has a side surface (cylindrical surface) in a direction that crosses the longitudinal direction of the double-acting cylinder 40 at a right angle. A stay 72 is provided at the mount frame 52 near the uppermost or thereabout of the swivel shaft 50. The stay 72 comprises two plates located at upper and lower positions in the vertical direction and each having an elongated hole 74 penetrated therethrough. The cylindrical element 70 is inserted in the holes 74 movably such that the driving end 40*a* of the double-acting cylinder 40 is connected to the mount frame 52 through the stay 72.

When the operator steers the steering wheel 28, the amount of steering is detected by the steering angle sensor 30 and is inputted to the ECU 22. The ECU 22 determines or calculates a current supply command in response to the inputted amount of steering and outputs the same to a driver circuit of the electric motor 66 through the harness to drive the hydraulic pump 62 such that the double-acting cylinder 40 extends or contracts. In response to the extension (or contraction) of the cylinder 40, the cylindrical element 70 (connected to the cylinder driving end 40*a*) moves along the stay's elongated slots. Thus, the extension (or contraction) of the cylinder 40 is translated to the rotation of the swivel shaft 50 through the mount frame 52.

Thus, by operating the double-acting cylinder 40 to extend or contract, the steering of the outboard motor 10 in the horizontal direction about the rotation of the swivel shaft 50 is power-assisted and the propeller 24 (and the rudder 26) is swung to steer the boat 16. Specifically, the swivel shaft 50 is rotates right (viewed from the above) relative to the boat 16 when the cylinder 40 is driven to extend, and the outboard motor 10 is steered right such that the boat 16 is steered left (viewed from the above). On the contrary, when the cylinder 40 is driven to contract, the swivel shaft 50 rotates left to steer the outboard 10 left such that the boat 16 is steered right.

Next, the hydraulic circuit 64 (that connects the hydraulic pump 62 to the double-acting cylinder 40, etc.) will be explained with reference to FIG. 5.

Figure 5:
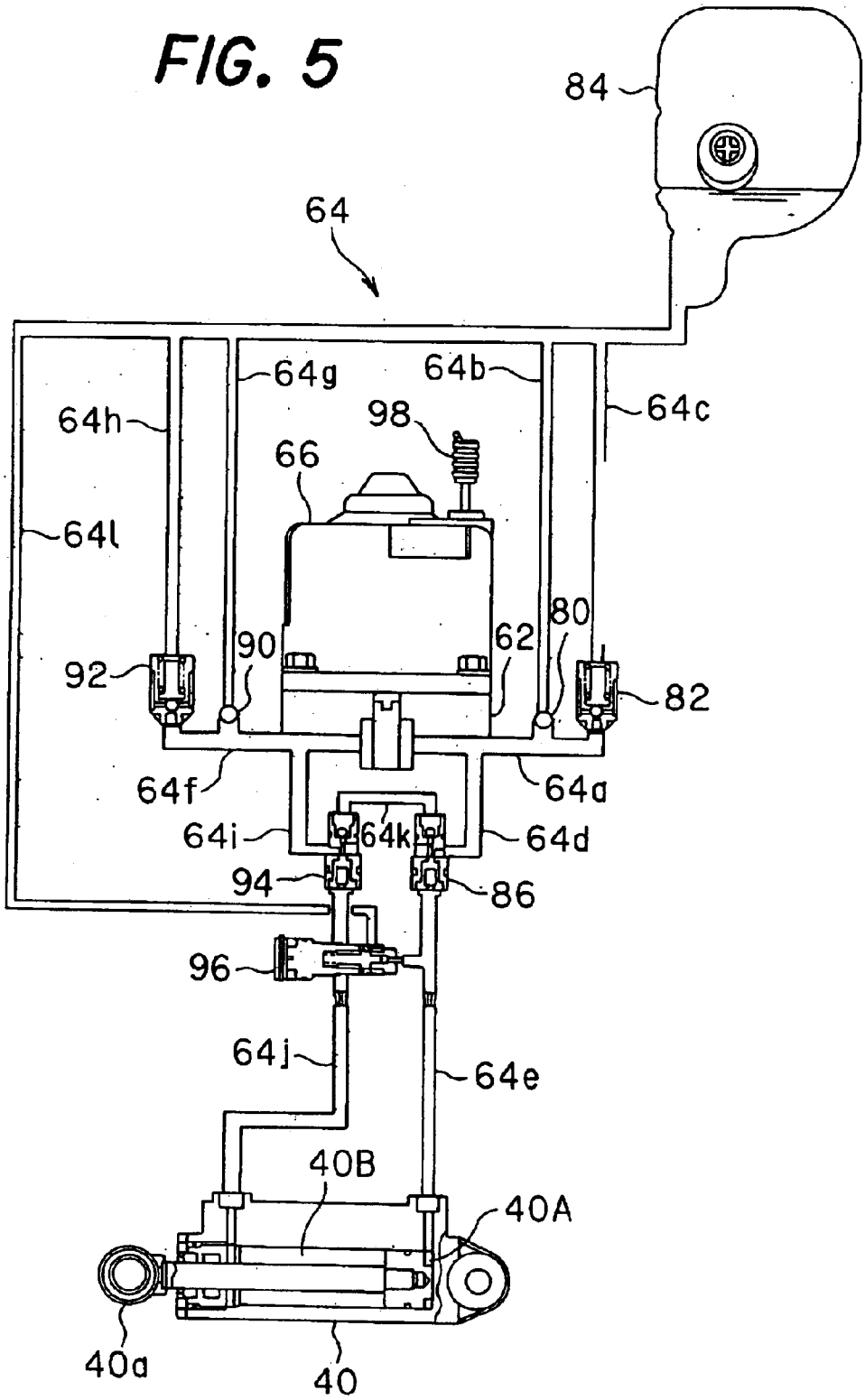
FIG. 5 is a circuit diagram of a hydraulic circuit showing the operation of a hydraulic pressure supplier that supplies hydraulic pressure to a hydraulic cylinder (double-acting cylinder) illustrated in FIG. 4.

FIG. 5 is a circuit diagram showing the hydraulic circuit 64.

As shown, the electric motor 66 is connected to the hydraulic pump 62. Specifically, the hydraulic pump 62 is a gear pump and is driven by the rotation inputted by the electric motor 66. The hydraulic pump 62 is connected, at one end, to a first check valve 80 and to a first relief valve 82 via an oil path 64*a*. The first check valve 80 and the first relief valve 82 are respectively connected to a tank (reservoir) 84 (where oil is reserved) via an oil path 64*b* and an oil path 64*c*.

Further, the hydraulic pump 62 is connected, at the one end, to a first switch valve 86, via an oil path 64*d*, that switches the direction of oil flow. Specifically, the first switch valve 86 is a pilot check valve whose primary side is connected to the oil path 64*d*, whilst whose secondary side is connected, via an oil path 64*e*, to a first oil chamber 40A of the double-acting cylinder 40.

Further, the hydraulic pump 62 is connected, at the other end, to a second check valve 90 and to a second relief valve 92 via an oil path 64*f*. The second check valve 90 and the second relief valve 92 are respectively connected to the tank 84 via an oil path 64*g* and an oil path 64*h*.

Furthermore, the hydraulic pump 62 is connected, at the other end, to a second switch valve 94, via an oil path 64*i* branched from the oil path 64*f*. Similarly to the first switch valve 86, the second switch valve 94 is a pilot check valve whose primary side is connected to the oil path 64*i*, whilst whose secondary side is connected, via the oil path 64*j*, to a second oil chamber 40B of the double-acting cylinder 40. The pilot side of the second switch valve 94 is connected to that of the first switch valve 86 via an oil path 64*k*.

A manual valve (with a thermal valve) 96 is provided in the oil path 64*e* that connects the first switch valve 86 to the first oil chamber 40A.

The hydraulic pressure supplier including the hydraulic circuit comprising the aforesaid oil paths, valves and tank is housed in the swivel case 12.

Thus, the outboard motor steering system according to this embodiment comprises the double-acting cylinder 40 (that rotates the swivel shaft 50 which acts as the steering shaft of the outboard motor 10), the hydraulic pressure supplier (that supplies hydraulic pressure to the double-acting cylinder 40), and the controller, i.e., the ECU 22 that controls the operation of the hydraulic pressure supplier. Among of them, the double-acting cylinder 40 and the hydraulic pressure supplier (that supplies hydraulic pressure thereto) are housed in the swivel case 12.

The operation of the hydraulic pressure supplier will then be explained with reference to FIG. 5.

When the ECU 22 is inputted, through harness (now assigned with reference numeral 98) with the amount of steering indicating that the outboard motor 10 is to be steered right to turn the boat 16 left, the ECU 22 calculates the current supply command and supplies it to the electric motor 66 such that it operates the hydraulic pump 62 discharges pressurized oil in the oil path 64*a*. When the hydraulic pump 62 is operated in this manner, oil reserved in the tank 84 flows along the line of the oil path 64*g*, the second check valve 90, the oil path 64*f*, the pump 62, the oil path 64*a* and the oil path 64*d*, and is supplied to the first switch valve 86.

At this time, the first switch valve 86 connects the oil path 64*d* to the oil path 64*e* such that the pressurized oil flows in the first oil chamber 40A of the double-acting cylinder 40. When the pressurized oil whose pressure is equal to or greater than a predetermined pressure acts on the pilot side of the second switch valve 94 through the oil path 64*k*, the second switch valve 94 connects the oil path 64*j* to the oil path 64*i* such that the second oil chamber 40B discharges the oil. With this, the double-acting cylinder 40 is driven to the extension direction, thereby enabling the outboard motor 10 to be steered right via the swivel shaft 50.

On the other hand, when the ECU 22 is inputted with the amount of steering indicating that the outboard motor 10 is to be steered left to turn the boat 16 right, the ECU 22 calculates the current supply command and supplies it to the electric motor 66 to rotate in the opposite direction, i.e., it operates the hydraulic pump 62 discharges the pressurized oil in the oil path 64*f*. As a result, the oil reserved in the tank 84 flows along the line of the oil path 64*b*, the first check valve 80, the oil path 64*a*, the pump 62, the oil path 64*f* and the oil path 64*i*, and is supplied to the second switch valve 94. With this, the second switch valve 94 connects the oil path 64*i* to the oil path 64*j* such that the pressurized oil flows in the second oil chamber 40B of the double-acting cylinder 40.

When the pressurized oil whose pressure is equal to or greater than a predetermined pressure acts on the pilot side of the first switch valve 86 through the oil path 64*k*, the first switch valve 86 connects the oil path 64*e* to the oil path 64*d* such that the first oil chamber 40A discharges the oil. With this, the double-acting cylinder 40 is driven to the contraction direction, thereby enabling the outboard motor 10 to be steered left via the swivel shaft 50.

When the hydraulic pressure supply to the first and second switch valves 86 and 94 is terminated, they disconnect the flow between the oil paths 64*d* and 64*e* and that between the oil paths 64*i* and 64*j* to prohibit oil from flowing out of the oil chambers 40A and 40B. With this, the double-acting cylinder 40 is kept at that position and the outboard motor 10 holds the steered angle at that time. If the temperature in the oil path 64*e* rises beyond a prescribed temperature, the manual valve 96 opens to connect the oil path 64*e* to the tank 84 through an oil path 64*l*, thereby causing the temperature and hence, the pressure to drop to a permissible level.

In case that the boat 16 is to be steered while the engine 18 is stopped, the operator can steer the boat with the use of a tiller handle (not shown) by manually opening the manual valve 96 by hand.

As stated above, the outboard motor steering system according to this embodiment is arranged such that the double-acting cylinder 40 that rotates the swivel shaft 50 acting as the steering shaft of the outboard motor 10, and the hydraulic pressure supplier that supplies the hydraulic pressure to the double-acting cylinder 40 are housed in the swivel case 12. Since the steering system is thus completed inside of the outboard motor 10, this add-on system can make the structure simple and can avoid increase in number of components and weight.

Further, since the system includes less number of connecting parts, this can decrease occurrence of play and improve the steering response and enhance steering feel. And the fact that the steering system is completed inside of the outboard motor 10 can save space on the boat 16.

Further, since the driving end 40*a* of the double-acting cylinder 40 is connected, via the stay 72, to the mount frame 52 (that is fastened to the swivel shaft 50) in such a manner that the double-acting cylinder 40 is extended or contracted to displace the swivel case 12 relative to the mount frame 52 such that the swivel shaft 50 is rotated, this can decrease the number of parts and can further make the structure simpler, thereby enabling to avoid degradation of operation efficiency in fabrication and maintenance. Specifically, since the connecting part is only a portion where the cylinder driving end 40*a* and the mount frame 52 (more precisely, the stay 72 mounted thereon), this can further decrease occurrence of play and can further improve the steering response and steering feel.

Further, since the hydraulic pressure supplier comprises the hydraulic pump 62 that supplies the hydraulic pressure to the double-acting cylinder 40, the hydraulic circuit 64 that connects the double-acting cylinder 40 to the hydraulic pump 62, and the electric motor 66 that drives the hydraulic pump 62, etc., this can eliminate a hydraulic hose or adapter and some similar factors to be installed on the boat 16, thereby enabling further space-saving. Since there is no fear that oil leaks from the hose or adapter, this can improve reliance of the system. Since the hydraulic pressure supplier is covered in the swivel case 12, its component such as the electric motor 66 can be protected from seawater and dust, enabling to further enhance the reliance of the system.

More specifically, since the hydraulic circuit 64 comprises the first and second check valves 80, 90 that defines oil flow, the first and second relief valves 82, 92 that avoid excessive pressure increase, the first and second switch valves 86, 94 that switch the direction of oil flow, the tank 84, the oil paths 64*a* to 64*l*, the manual valve 96 that connects the cylinder 40 and the tank 84 by operator's manual operation, this can eliminate a hydraulic hose or adapter and some similar factors to be installed on the boat 16, thereby enabling further space-saving. Since there is no fear that oil leaks from the hose or adapter, this can improve reliance of the system.

Further, since the double-acting cylinder 40 and the electric motor 66 are arranged in such a way that their longitudinal directions are in parallel with each other, this can allow them to be installed in a compact manner, thereby enabling to further space-saving.

Further, since the system includes the manual valve 96 that connects the cylinder 40 to the tank 84, the outboard motor 10 can be steered by manually opening the valve 96 and by using a tiller handle when the engine 18 is stopped or if the electric motor 66 is in failure.

It should be noted in the above that, although the ECU 22 is located within the engine cover 20 near the engine 18, it may be located in the swivel case 12 together with the double-acting cylinder 40 and the hydraulic pressure supplier.

An outboard motor steering system according to a second embodiment of the invention will now be explained with reference to FIG. 6 and FIG. 7.

Figure 6:
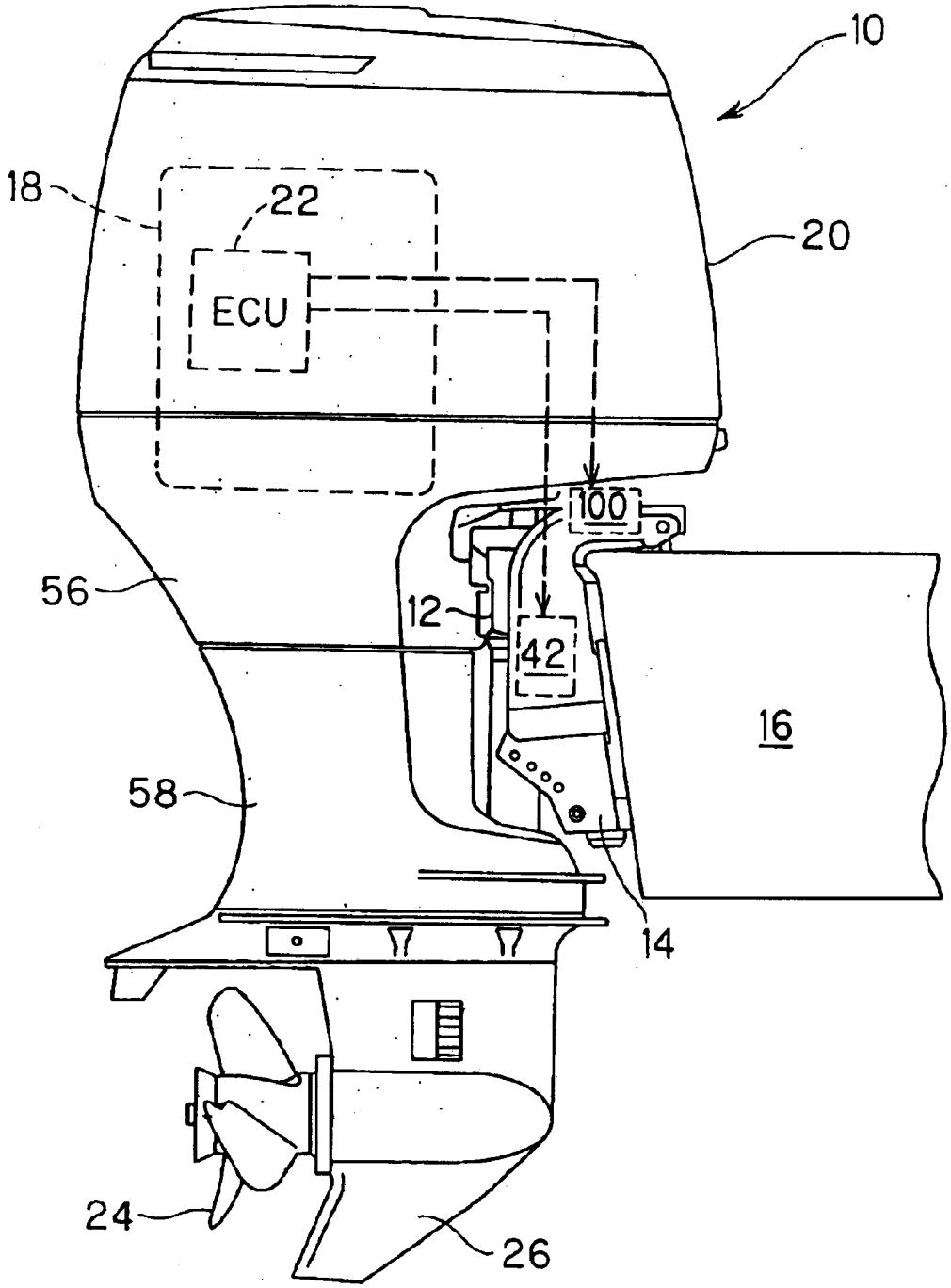
FIG. 6 is a view, similar to FIG. 2, but showing an outboard motor steering system according to a second embodiment of the invention.
Figure 7:
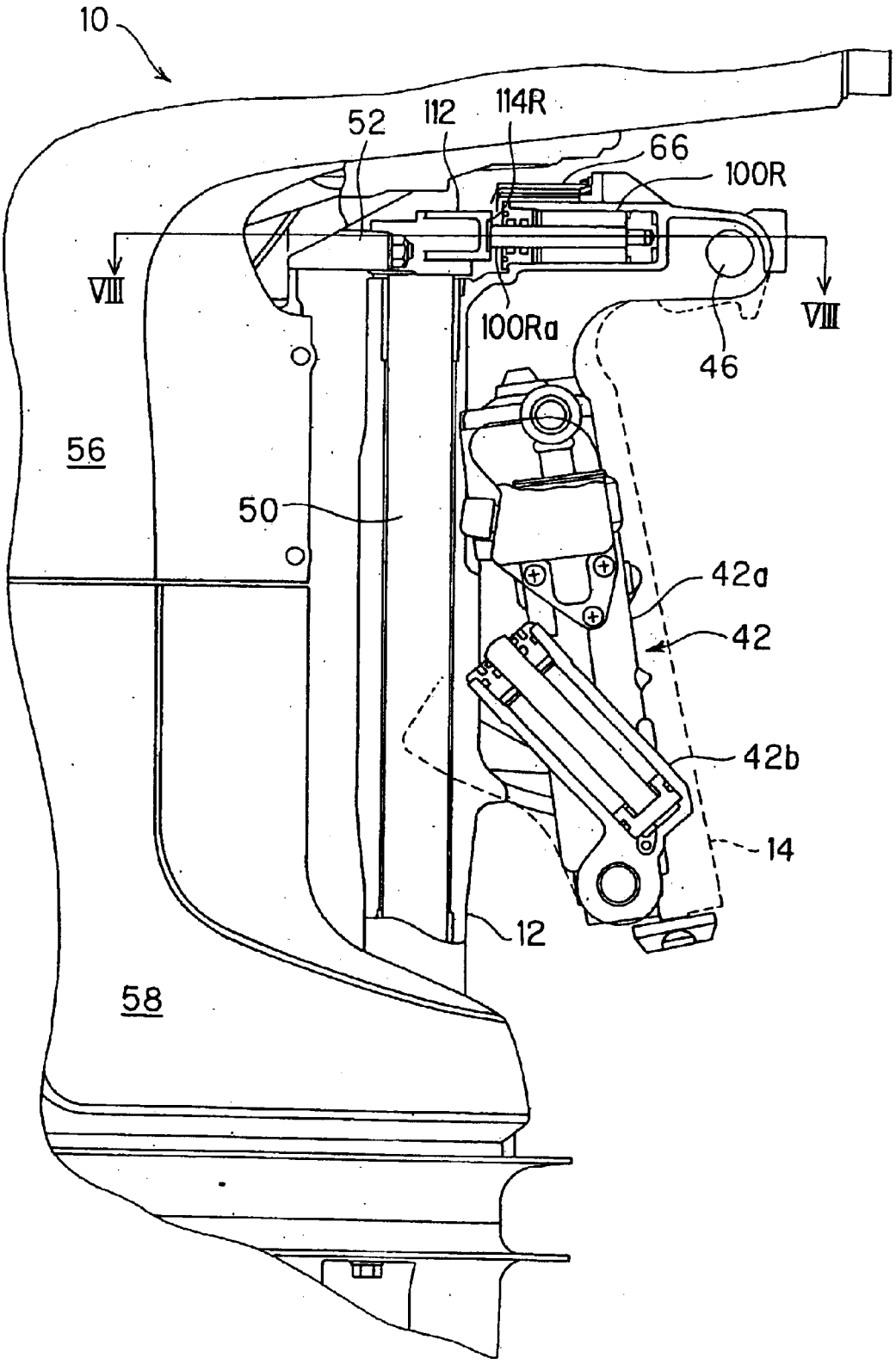
FIG. 7 is a view, similar to FIG. 3, but showing the outboard motor steering system according to the second embodiment.

FIG. 6 and FIG. 7 are view, similar to FIG. 2 and FIG. 3, but showing the outboard motor steering system according to the second embodiment of the invention. The same reference numerals in these figures and on indicate the same elements used in the first embodiment.

Explaining this with focus on the differences from the first embodiment, in the second embodiment, instead of the double-acting cylinder 40, a pair of single-acting cylinders (hydraulic actuators) 100 are housed inside the swivel case 12 to rotate the swivel shaft 50.

Figure 8:
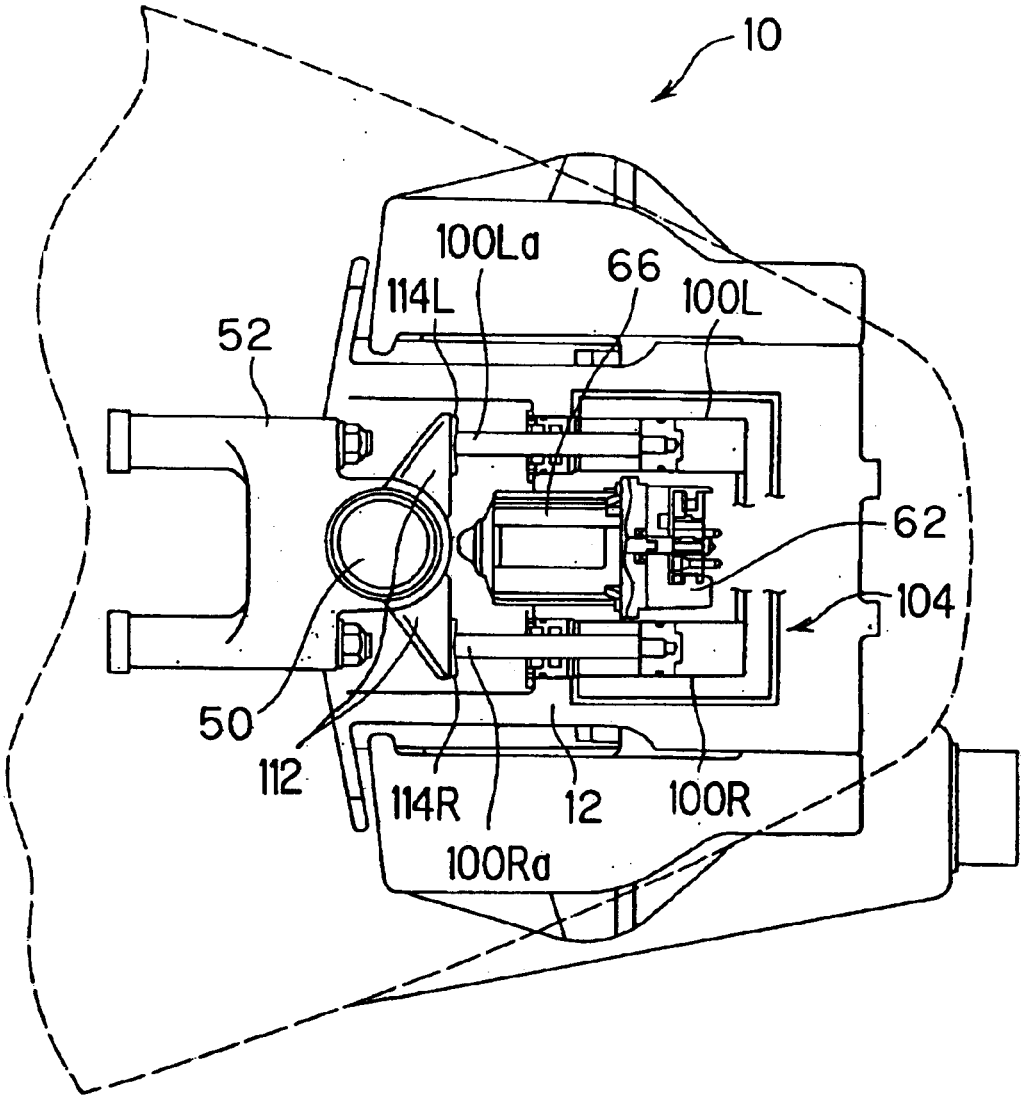
FIG. 8 is a cross-sectional view taken along the line VIII—VIII of FIG. 7.

FIG. 8 is a cross-sectional view taken along VIII—VIII line of FIG. 7.

As shown in FIGS. 7 and 8, within the interior space of the swivel case 12, there are housed and fixed the aforesaid two single-acting cylinders 100 (the right one is referred to as the "first single-acting cylinder 100R" and the left one "second single-acting cylinder 100L"), and a hydraulic pressure supplier comprising the aforesaid hydraulic pump 62 that supplies hydraulic pressure to the cylinders 100, a hydraulic circuit 104 that connects the pump 62 to the cylinders 100, and the aforesaid electric motor 66. The right and left are termed, throughout this specification, when viewed from a position behind the boat 16 and the outboard motor 10. As illustrated in FIG. 8, the first and second single-acting cylinders 100R, 100L are symmetrically provided at left and right positions relative to the axis of the swivel shaft 50.

A pair of stays 112 is provided at the mount frame 52 near the uppermost or thereabout of the swivel shaft 50. The stays 112 are symmetrically provided at left and right positions relative to the axis of the swivel shaft 50. The right stay 112 has a first contact 114R, whilst the left stay 112 has a second contact 114L. The first contact 114R is brought into contact with a driving end 100Ra of the first single-acting cylinder 100R, whereas the second contact 114L is brought into contact with a driving end 100La of the second single-acting cylinder 100L.

When the operator steers the steering wheel 28, the amount of steering is detected by the steering angle sensor 30 and is inputted to the ECU 22. The ECU 22 determines or calculates the current supply command in response to the inputted amount of steering and outputs the same to a driver circuit of the electric motor 66 through harness 98 to drive the hydraulic pump 62 such that the first and second single-acting cylinders 100 extend or contract.

When one of the first and second single-acting cylinders 100R, 100L is driven in the extension direction, its driving end pushes the associated one of stays 112 through the corresponding one of the contact 114R, 114L such that the mount frame 52 moves relative to the swivel shaft 50, in other words, the swivel shaft 50 rotates relative to the mount frame 52. At that time, the hydraulic pressure in the other cylinder 100L or 100R is discharged and its driving end is pushed by the associated one of the stays 112, such that the other cylinder is contracted. Notably, each of the cylinders driving ends 100Ra, 100La and each of the contacts 114R, 114L corresponding thereto are formed with arcuate surfaces in such a manner that the areas of contact remain unchanged irrespectively of the angle of rotation of the swivel shaft 50.

Thus, by operating the two single-acting cylinders 100 to extend or contract, the steering of the outboard motor 10 in the horizontal direction about the rotation of the swivel shaft 50 is power-assisted and the propeller 24 (and the rudder 26) is swung to steer the boat 16. Specifically, the swivel shaft 50 rotates right (viewed from the above) relative to the boat 16 when the first single-acting cylinder 100R is driven to extend, and the outboard motor 10 is steered right such that the boat 16 is steered left (viewed from the above). On the contrary, when the second single-acting cylinder 100L is driven to extend, the swivel shaft 50 rotates left to steer the outboard 10 left such that the boat 16 is steered right.

Next, the hydraulic circuit 104 (that connects the hydraulic pump 62 to the two single-acting cylinders 100, etc.) will be explained with reference to FIG. 9.

Figure 9:
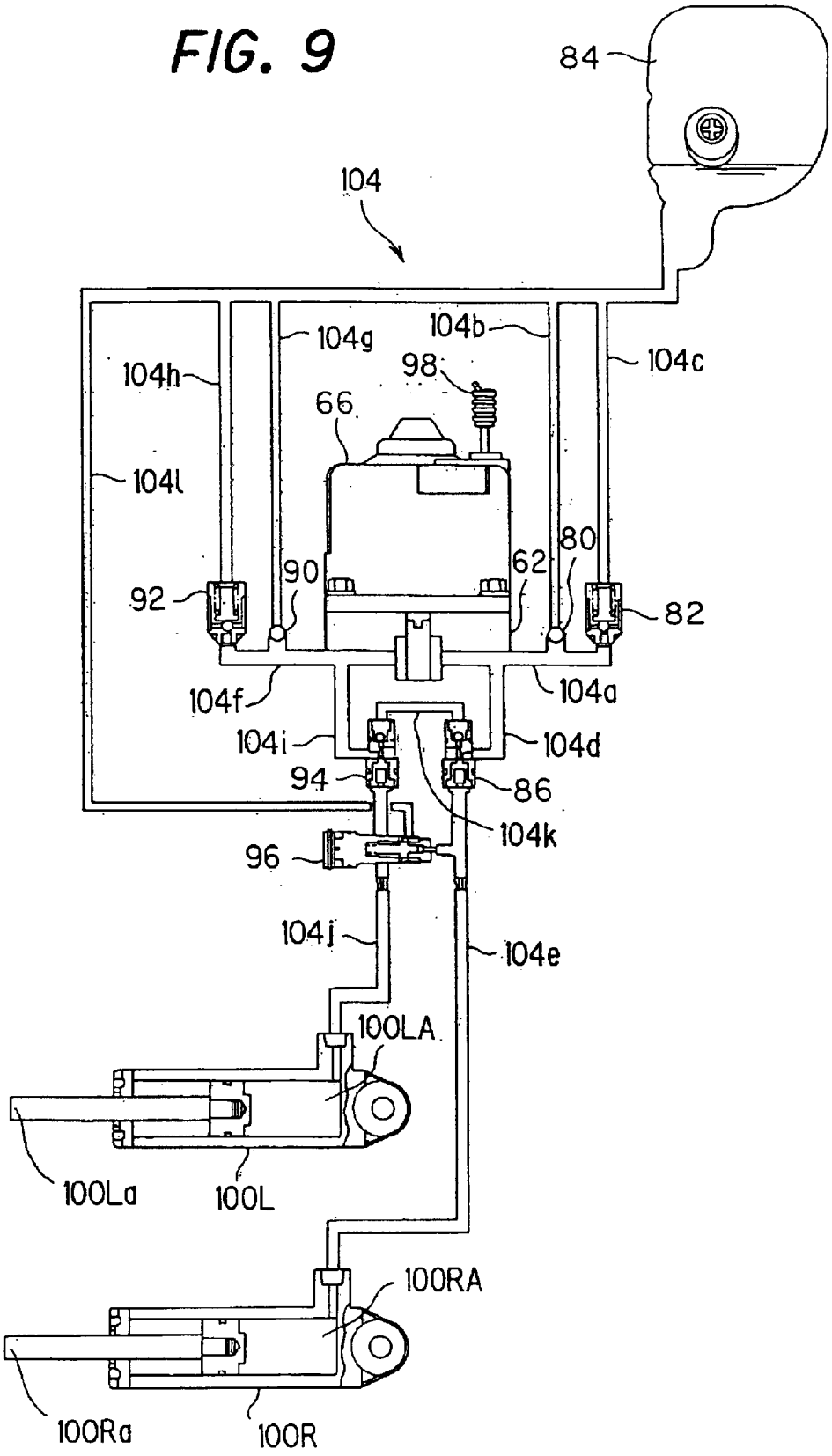
FIG. 9 is a circuit diagram of a hydraulic circuit showing the operation of a hydraulic pressure supplier that supplies hydraulic pressure to hydraulic cylinders (single-acting cylinders) illustrated in FIG. 8.

FIG. 9 is a circuit diagram showing the hydraulic circuit 104.

Explaining this with emphasis on the differences from the hydraulic circuit 64 in the first embodiment, the first switch valve 86 is connected, at its primary side, to an oil path 104*d*, and is, connected, at its secondary side, to an oil chamber 100RA of the first single-acting cylinder 100R through an oil path 104*e*. The second switch valve 94 is connected, at its primary side, to an oil path 104*i*, and is connected, at its secondary side, to an oil chamber 100LA of the second single-acting cylinder 100L through an oil path 104*j*.

Thus, the outboard motor steering system according to the second embodiment comprises the first and second single-acting cylinders 100R, 100L (that rotate the swivel shaft 50 which acts as the steering shaft of the outboard motor 10), the hydraulic pressure supplier (that supplies hydraulic pressure to the first and second single-acting cylinders 100R, 100L), and the controller, i.e., the ECU 22 that controls the operation of the hydraulic pressure supplier. Among of them, the first and second single-acting cylinders 100R, 100L and the hydraulic pressure supplier (that supplies hydraulic pressure thereto) are housed in the swivel case 12.

The operation of the hydraulic pressure supplier will then be explained with reference to FIG. 9.

When the ECU 22 is inputted with the amount of steering indicating that the outboard motor 10 is to be steered right to turn the boat 16 left, the ECU 22 calculates the current supply command and supplies it to the electric motor 66 such that it operates the hydraulic pump 62 discharges or pumps pressurized oil in the oil path 104*a*. When the hydraulic pump 62 is operated in this manner, oil reserved in the tank 84 flows along the line of an oil path 104*g*, the second check valve 90, an oil path 104*f*, the pump 62, the oil path 104*a* and an oil path 104*d*, and is supplied to the first switch valve 86, and flows in the oil chamber 100RA of the first single-acting cylinder 100R.

When the pressurized oil whose pressure is equal to or greater than the predetermined pressure acts on the pilot side of the second switch valve 94 through an oil path 104*k*, the second switch valve 94 connects the oil path 104*j* to the oil path 104*i*. With this, the first single-acting cylinder 100R is driven to the extension direction such that whose driving end 100Ra pushes the corresponding stay 112 through the associated contact 114R to rotate the swivel shaft 50 right, thereby enabling the outboard motor 10 to be steered right. At this time, as mentioned above, the driving end 100La of the second single-acting cylinder 100L is pushed by the corresponding stay 112 through the associated contact 114L such that the second single-acting cylinder 100L discharges the pressurized oil to contract.

On the other hand, when the ECU 22 is inputted with the amount of steering indicating that the outboard motor 10 is to be steered left to turn the boat 16 right, the ECU 22 calculates the current supply command and supplies it to the electric motor 66 to rotate in the opposite direction, i.e., it operates the hydraulic pump 62 discharges pressurized oil in the oil path 104*f*. As a result, oil reserved in the tank 84 flows along the line of the oil path 104*b*, the first check valve 80, the oil path 104*a*, the pump 62, the oil path 104*f* and the oil path 104*i*, and is supplied to the second switch valve 94. With this, the second switch valve 94 connects the oil path 104*i* to the oil path 104*j* such that the pressurized oil flows in the oil chamber 100La of the second single-acting cylinder 100L.

When the pressurized oil whose pressure is equal to or greater than the predetermined pressure acts on the pilot side of the first switch valve 86 through an oil path 104*k*, the first switch valve 86 connects the oil path 104*e* to the oil path 104*d*. With this, the second single-acting cylinder 100L is driven to the extension direction, such that whose driving end 100La pushes the corresponding stay 112 through the associated contact 114L to rotate the swivel shaft 50 left, thereby enabling the outboard motor 10 to be steered left. At this time, the driving end 100Ra of the first single-acting cylinder 100R is pushed by the corresponding stay 112 through the associated contact 114R such that the first single-acting cylinder 100R discharges the pressurized oil to contract.

As stated above, the outboard motor steering system according to the second embodiment is arranged such that the first and second single-acting cylinders 100 that rotate the swivel shaft 50 acting as the steering shaft of the outboard motor 10, and the hydraulic pressure supplier that supplies the hydraulic pressure to the first and second single-acting cylinders 100 are housed in the swivel case 12. Since the steering system is completed inside of the outboard motor 10, this add-on system can make the structure simple and can avoid increase in number of components and weight.

Further, since the first and second single-acting cylinders 100R, 100L are symmetrically arranged at left and right positions relative to the swivel shaft 50 and their driving ends 100Ra, 100La are connected, via the contacts 114R, 114L each fastened to the stays 112, to the mount frame 52 (that is fastened to the swivel shaft 50) in such a manner that the first and second single-acting cylinders 100 are extended or contracted to displace the swivel case 12 relative to the mount frame 52 such that the swivel shaft 50 is rotated, this can decrease the number of parts and can further make the structure simpler, thereby enabling to avoid degradation of operation efficiency in fabrication and maintenance.

Further, since there is no moving parts and since the cylinder driving ends 100Ra, 100La are always brought into contact with the contacts 114R, 114L fixed to the stays 112, this can eliminate occurrence of play and can further improve the steering response and steering feel.

Further, it is arranged such that the right steering is conducted by driving the first single-acting cylinder 100R to extend, whilst the left steering is conducted by driving the second single-acting cylinder 100L, to extend, that is installed at the position symmetrical to that of the first single-acting cylinder 100R relative to the axis of the swivel shaft 50, the driving speed and torque in the right steering and left steering is made equal to each other, thereby enabling to avoid occurrence of difference in the driving (i.e., the steering angle and angular speed).

Further, since the hydraulic pressure supplier comprises the hydraulic pump 62 that supplies the hydraulic pressure to the first and second single-acting cylinders 100R, 100L, the hydraulic circuit 104 that connects the cylinders 100 to the pump 62, and the electric motor 66 that drives the hydraulic pump 62, this can eliminate a hydraulic hose or adapter and some similar factors to be installed on the boat 16, thereby enabling further space-saving. Since there is no fear that oil leaks from the hose or adapter, this can improve reliance of the system. Since the hydraulic pressure supplier is covered in the swivel case 12, its component such as the electric motor 66 can be protected from seawater and dust, enabling to further enhance the reliance of the system.

It should be noted in the above that, although the ECU 22 is housed inside the engine cover 20 near the engine 18, it may be housed in the swivel case 12 together with the first and second single-acting cylinders 100R, 100L and the hydraulic pressure supplier.

An outboard motor steering system according to a third embodiment of the invention will now be explained with reference to FIG. 10 and FIG. 11.

Figure 10:
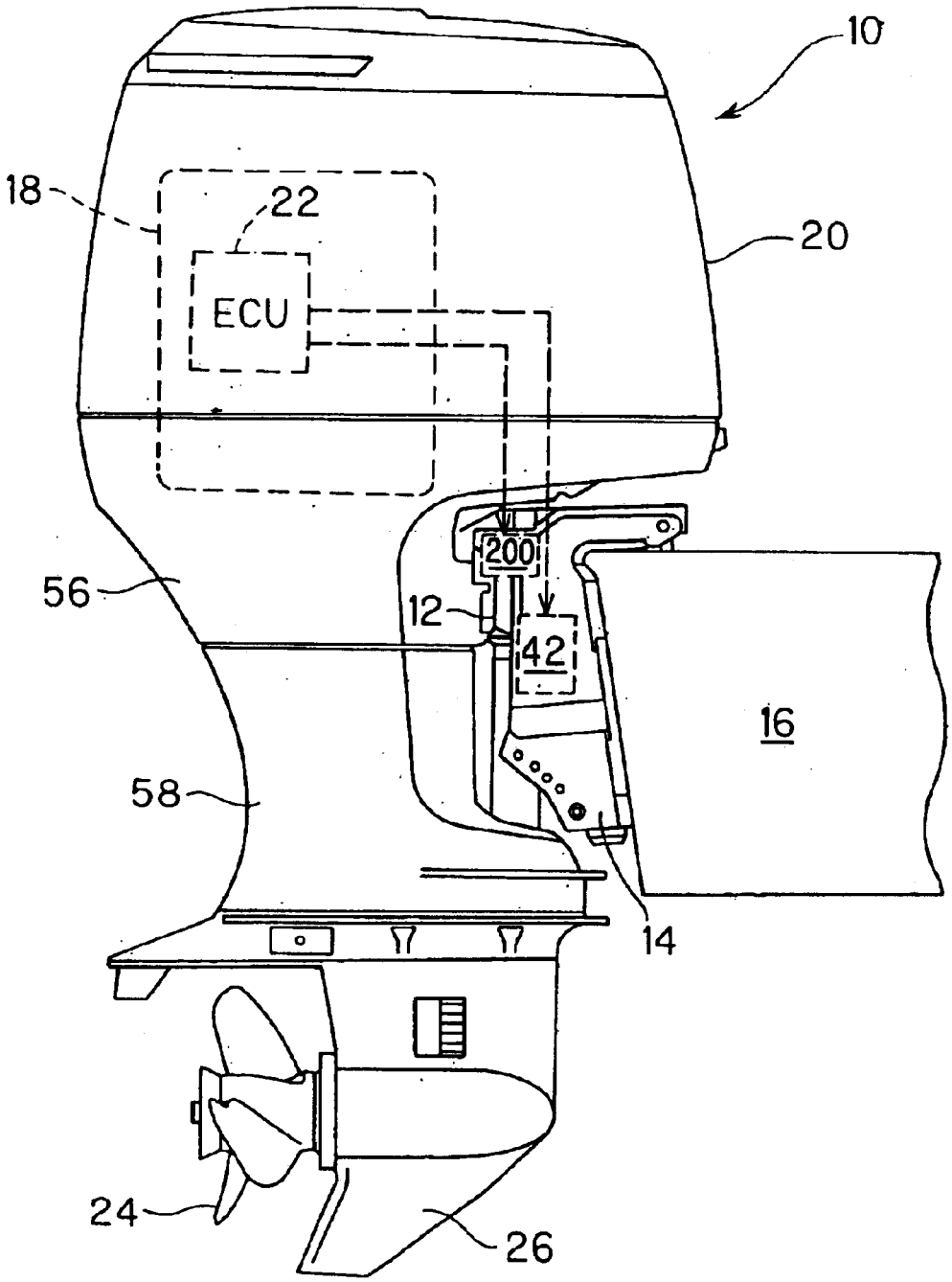
FIG. 10 is a view, similar to FIG. 2, but showing an outboard motor steering system according to a third embodiment of the invention.
Figure 11:
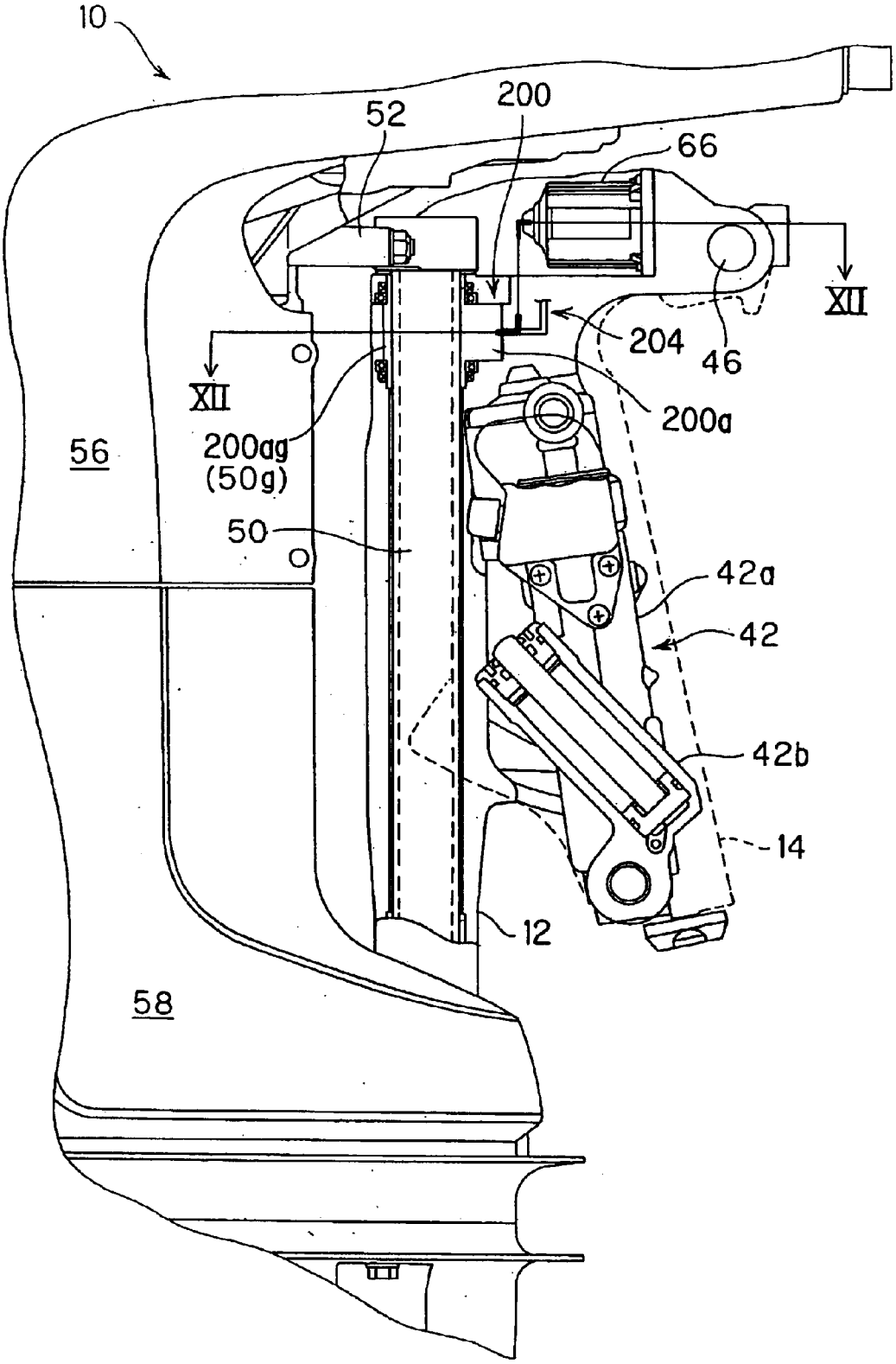
FIG. 11 is a view, similar to FIG. 3, but showing the outboard motor steering system according to the third embodiment.

FIG. 10 and FIG. 11 are views, similar to FIG. 2 and FIG. 3, but showing the outboard motor steering system according to the third embodiment of the invention. The same reference numerals in these figures and on indicate the same elements used in the first embodiment.

Explaining this with focus on the differences from the foregoing embodiments, in the third embodiment, instead of the hydraulic cylinders used in the systems according to the foregoing embodiments, a rotary vane motor (hydraulic actuator) 200 is housed inside the swivel case 12 to rotate the swivel shaft 50.

Figure 12:
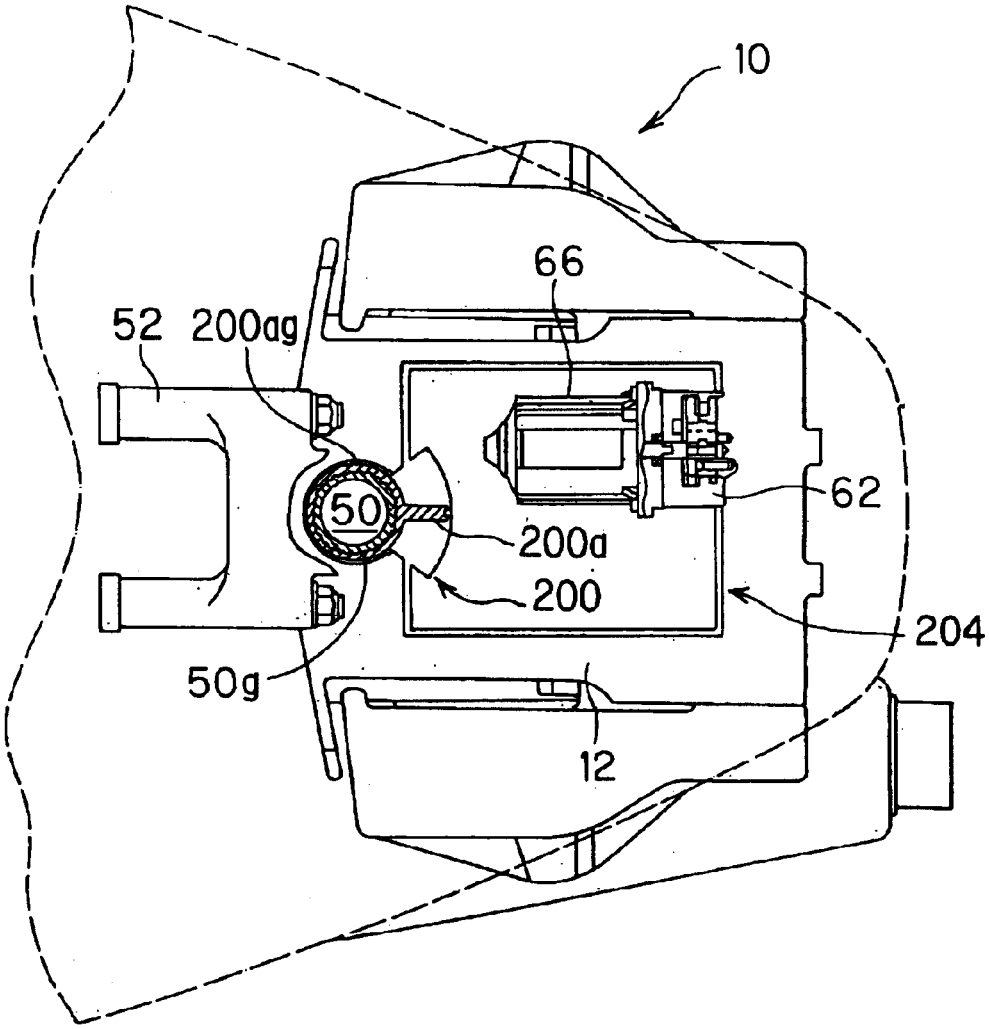
FIG. 12 is a cross-sectional view taken along the line XII—XII of FIG. 11.

FIG. 12 is a cross-sectional view taken along XII—XII line of FIG. 11.

As shown in FIGS. 11 and 12, the swivel case 12 is enlarged and in the interior space formed there, the rotary vane motor (hereinafter referred to as the "vane motor") 200 is housed and fixed at the upper end or adjacent thereto of the swivel shaft 50. Specifically, the vane motor 200 is installed around the swivel shaft in such a manner that a rotation axis of a vane 200*a* is coaxial with the rotation axis of the swivel shaft 50. More specifically, the vane 200*a* has an inner toothed gear 200*ag* that meshes with a spur gear 50*g* formed around the swivel shaft 50.

With this, the swivel shaft 50 is rotated when the vane 200*a* of the vane motor 200 is rotated. In other words, the swivel shaft 50 is directly rotated by the rotation of the vane motor 200, without interposing any medium such as a link mechanism therebetween.

As illustrated in the figures, in the interior space formed at the upper portion of the swivel case 12, there is housed and fixed a hydraulic pressure supplier comprising the hydraulic pump 62 that supplies hydraulic pressure to the vane motor 200, a hydraulic circuit 204 (only partially shown) that connects the hydraulic pump 62 to the vane motor 200, and the electric motor 66 that drives the hydraulic pump 62.

When the operator steers the steering wheel 28, the amount of steering is detected by the steering angle sensor 30 and is inputted to the ECU 22. The ECU 22 determines or calculates the current supply command in response to the inputted amount of steering and outputs the same to the driver circuit of the electric motor 66 through harness to drive the hydraulic pump 62 such that the vane motor 200 is rotated. The rotation of the vane 200*a* resulting in therefrom is transmitted to the swivel shaft 50 through the gears 200*ag* and 50*g*. Thus, by operating the vane motor 200 to rotate, the steering of the outboard motor 10 in the horizontal direction about the rotation of the swivel shaft 50 is power-assisted and the propeller 24 (and the rudder 26) is rotated to steer the boat 16.

Next, the hydraulic circuit 204 (that connects the hydraulic pump 62 to the vane motor 200, etc.) will be explained with reference to FIG. 13.

Figure 13:
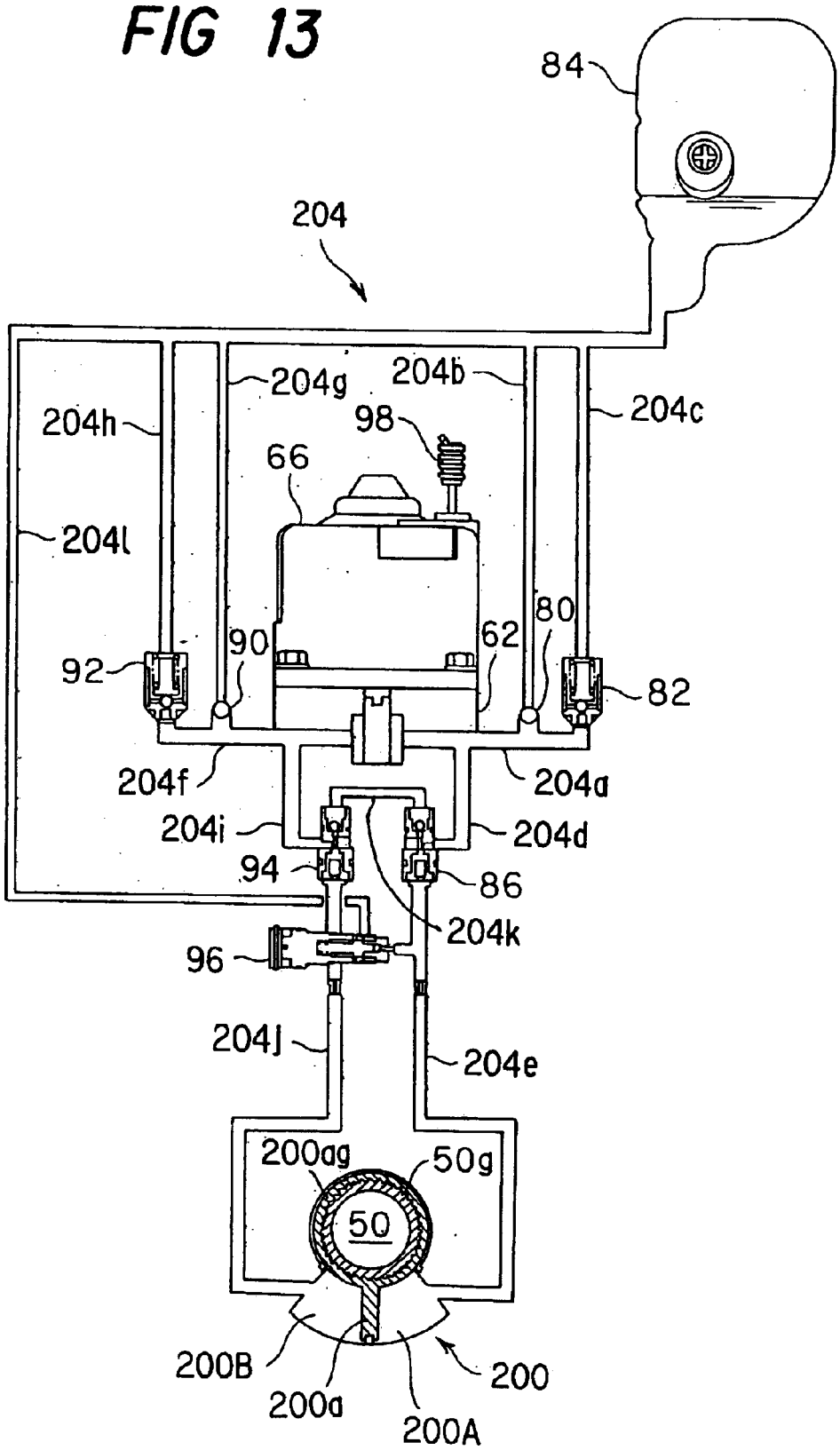
FIG. 13 is a circuit diagram of a hydraulic circuit showing the operation of a hydraulic pressure supplier that supplies hydraulic pressure to a rotary vane motor illustrated in FIG. 12.

FIG. 13 is a circuit diagram showing the hydraulic circuit 204.

Explaining this with emphasis on the differences from the hydraulic circuits in the foregoing embodiments, the first switch valve 86 is connected, at its primary side, to an oil path 204*d*, and is, connected, at its secondary side, to a first oil chamber 200A of the vane motor 200 through an oil path 204*e*. The second switch valve 94 is connected, at its primary side, to an oil path 204*i*, and is connected, at its secondary side, to a second oil chamber 200B of the vane motor 200 through an oil path 204*j*.

Thus, the outboard motor steering system according to the third embodiment comprises the vane motor 200 (that rotate the swivel shaft 50 which acts as the steering shaft of the outboard motor 10), the hydraulic pressure supplier (for supplying hydraulic pressure to the vane motor 200), and the controller, i.e., the ECU 22 that controls the operation of the hydraulic pressure supplier. Among of them, the vane motor 200 and the hydraulic pressure supplier (that supplies hydraulic pressure thereto) are housed in the swivel case 12.

The operation of the hydraulic pressure supplier will then be explained with reference to FIG. 13.

When the ECU 22 is inputted with the amount of steering indicating that the outboard motor 10 is to be steered right to turn the boat 16 left, the ECU 22 calculates the current supply command and supplies it to the electric motor 66 such that it operates the hydraulic pump 62 discharges or pumps pressurized oil in an oil path 204*a*. When the hydraulic pump 62 is operated in this manner, oil reserved in the tank 84 flows along the line of the oil path 204*g*, the second check valve 90, the oil path 204*f*, the pump 62, the oil path 204*a* and an oil path 204*d*, and is supplied to the first switch valve 86, and then flows in the first oil chamber 200A of the vane motor 200.

When the pressurized oil whose pressure is equal to or greater than the predetermined pressure acts on the pilot side of the second switch valve 94 through an oil path 204*k*, the second switch valve 94 connects the oil path 204*j* to the oil path 204*i* such that the pressurized oil in the second oil chamber 200B flows out. With this, the vane 200*a* of the vane motor 200 rotates right to rotate the swivel shaft 50 in the same direction, thereby enabling the outboard motor 10 to be steered right.

On the other hand, when the ECU 22 is inputted with the amount of steering indicating that the outboard motor 10 is to be steered left to turn the boat 16 right, the ECU 22 calculates the current supply command and supplies it to the electric motor 66 to rotate in the opposite direction, i.e, it operates the hydraulic pump 62 discharges pressurized oil in the oil path 204*f*. As a result, oil reserved in the tank 84 flows along the line of the oil path 204*b*, the first check valve 80, the oil path 204*a*, the pump 62, the oil path 204*f* and the oil path 204*i*, and is supplied to the second switch valve 94.

With this, the second switch valve 94 connects the oil path 204*i* to the oil path 204*j* such that the pressurized oil flows in the second oil chamber 200B of the vane motor 200. When the pressurized oil whose pressure is equal to or greater than the predetermined pressure acts on the pilot side of the first switch valve 86 through an oil path 204*k*, the first switch valve 86 connects the oil path 204*e* to the oil path 204*d* such that the pressurized oil flow out from the first oil chamber 200A. With this, the vane 200*a* of the vane motor 200 rotates left to rotate the swivel shaft 50 in the same direction, thereby enabling the outboard motor 10 to be steered left.

As stated above, the outboard motor steering system according to the third embodiment is arranged such that vane motor 200 that rotate the swivel shaft 50 acting as the steering shaft of the outboard motor 10, and the hydraulic pressure supplier that supplies the hydraulic pressure to the vane motor 200 are housed in the swivel case 12. Since the steering system is completed inside of the outboard motor 10, this add-on system can make the structure simple and can avoid increase in number of components and weight.

Further, since the vane motor 200 is installed around the swivel shaft in such a manner that the rotation axis of the vane 200*a* is coaxial with the rotation axis of the swivel shaft 50 in such manner that the swivel shaft 50 is directly driven by the vane motor 200, this can decrease the number of parts and can further make the structure simpler, thereby enabling to avoid degradation of operation efficiency in fabrication and maintenance.

Further, since the vane 200*a* of the vane motor 200 is arranged around the swivel shaft 50, this can increase the freedom of designing the height (i.e., the height of the swivel shaft 50) of the vane 200*a*. In other words, since it becomes possible to design or set the height of the vane 200*a* to a desired value, it becomes possible to design or set the area of the vane 200*a* (on which the pressured oil exerts) to a desired value so as to achieve a desired steering (driving) speed and a desired torque.

Further, since there is no moving part, this can eliminate occurrence of play and can further improve the steering response and steering feel.

Further, since it is arranged such that the right or left steering is conducted by directly rotating the swivel shaft 50 by the rotation of the vane motor 200, the driving speed and torque in the right steering and left steering is made equal to each other, thereby enabling to avoid occurrence of difference in the driving (i.e., the steering angle and angular speed).

Further, since the hydraulic pressure supplier comprises the hydraulic pump 62 that supplies the hydraulic pressure to the vane motor 200, the hydraulic circuit 204 that connects the vane motor 200 to the pump 62, and the electric motor 66 that drives the hydraulic pump 62, this can eliminate a hydraulic hose or adapter and some similar factors to be installed on the boat 16, thereby enabling further space-saving. Since there is no fear that oil leaks from the hose or adapter, this can improve reliance of the system. Since the hydraulic pressure supplier is covered in the swivel case 12, its component such as the electric motor 66 can be protected from seawater and dust, enabling to further enhance the reliance of the system.

It should be noted in the above, although the ECU 22 is housed inside the engine cover 20 near the engine 18, the ECU 22 may be housed in the swivel case 12 together with the vane motor 200 and the hydraulic pressure supplier.

It should also be noted that, although the vane motor 200 is housed in the swivel case 12 at the position near the upper end or thereabout of the swivel shaft 50, the location of the vane motor 200 should not be limited thereto and may be located at any position in the swivel case 12 such as at a midway position or at a lower position of the swivel shaft 50.

An outboard motor steering system according to a fourth embodiment of the invention will now be explained with reference to FIG. 14 and FIG. 15.

Figure 14:
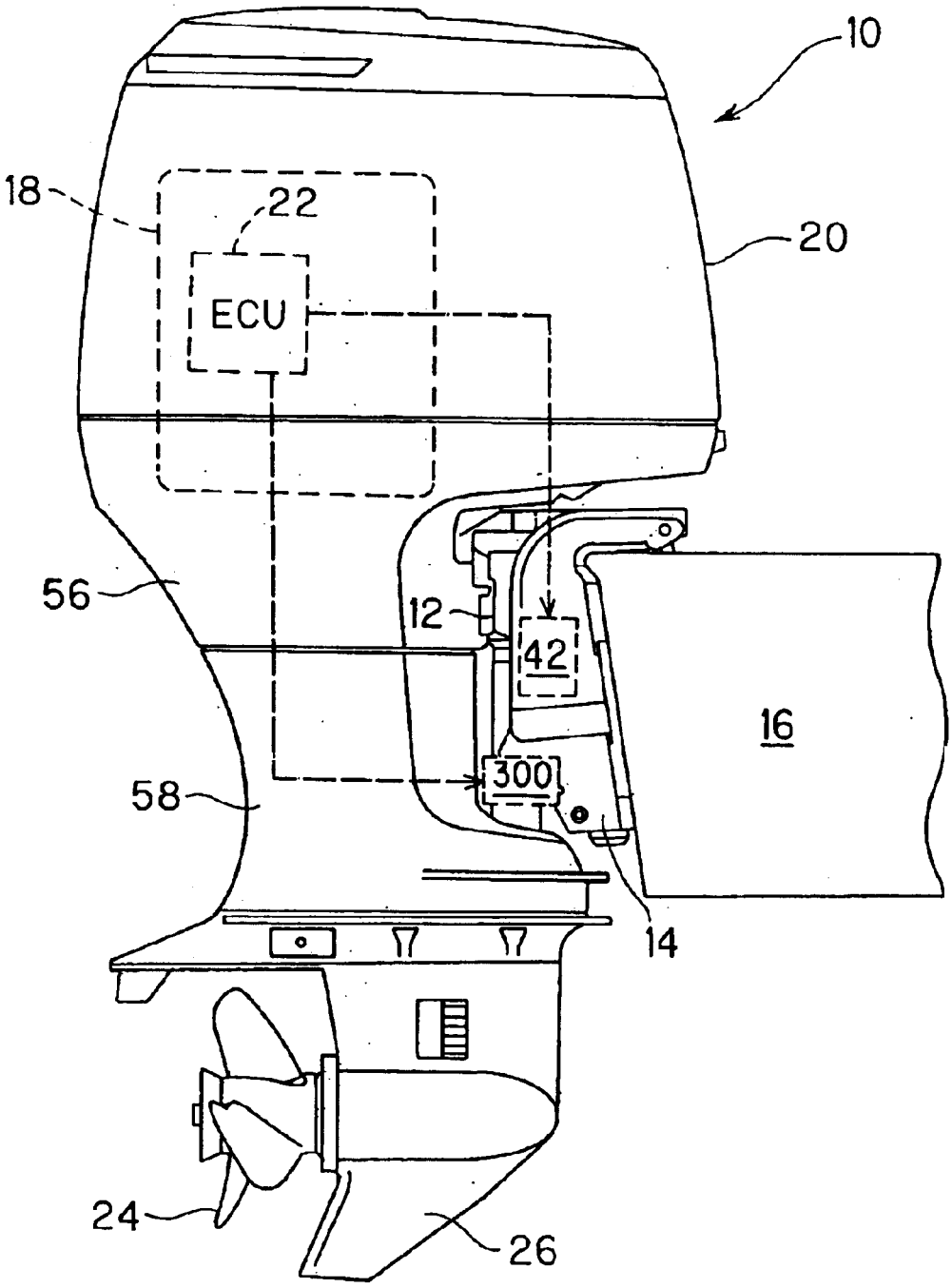
FIG. 14 is a view, similar to FIG. 2, but showing an outboard motor steering system according to a fourth embodiment of the invention.
Figure 15:
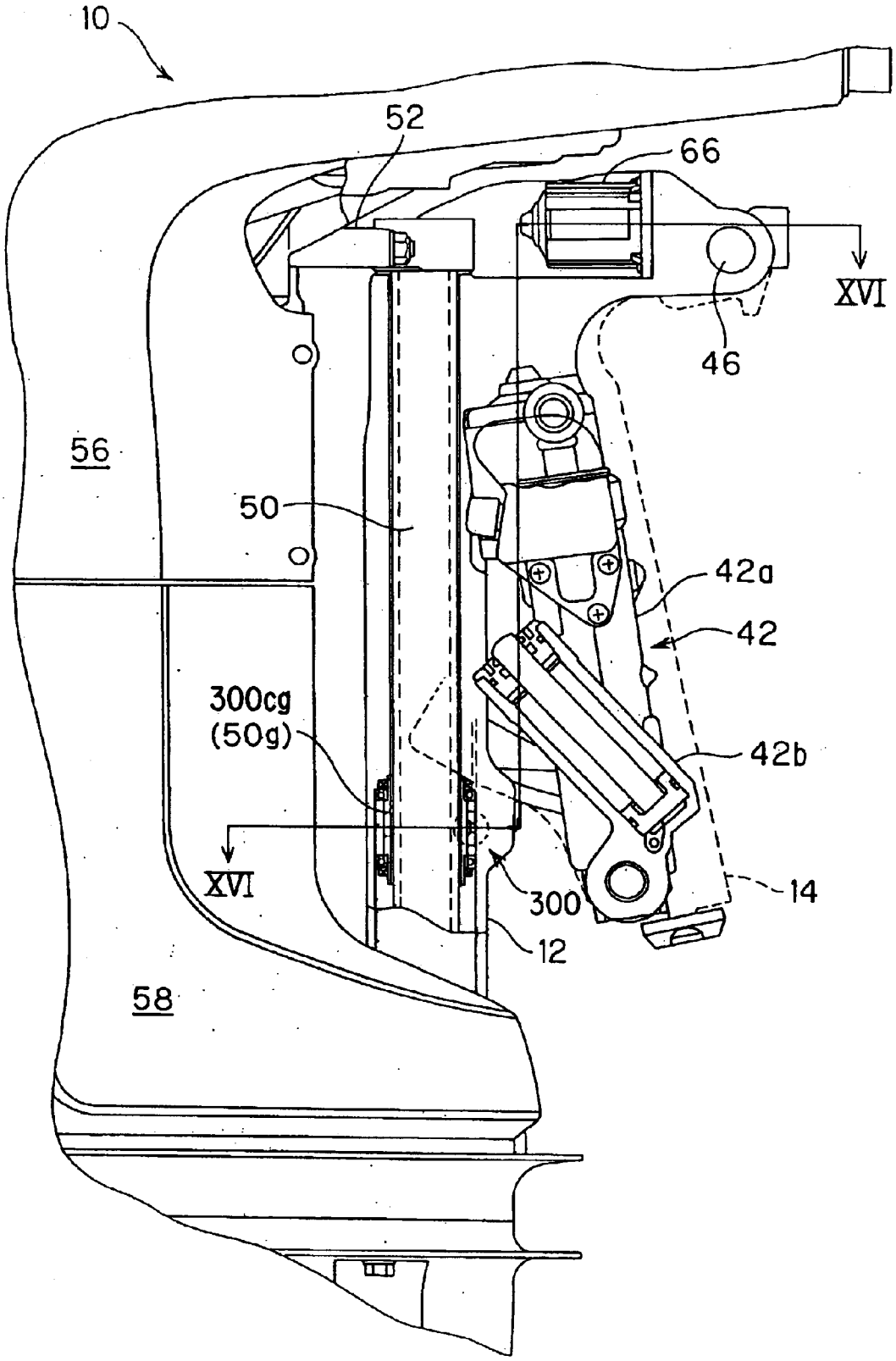
FIG. 15 is a view, similar to FIG. 3, but showing the outboard motor steering system according to the fourth embodiment.

FIG. 14 and FIG. 15 are views, similar to FIG. 2 and FIG. 3, but showing the outboard motor steering system according to the fourth embodiment of the invention. The same reference numerals in these figures and on indicate the same elements used in the first embodiment.

Explaining this with focus on the differences from the foregoing embodiments, in the fourth embodiment, a rotary piston motor (hydraulic actuator) 300 is housed inside the swivel case 12 to rotate the swivel shaft 50.

Figure 16:
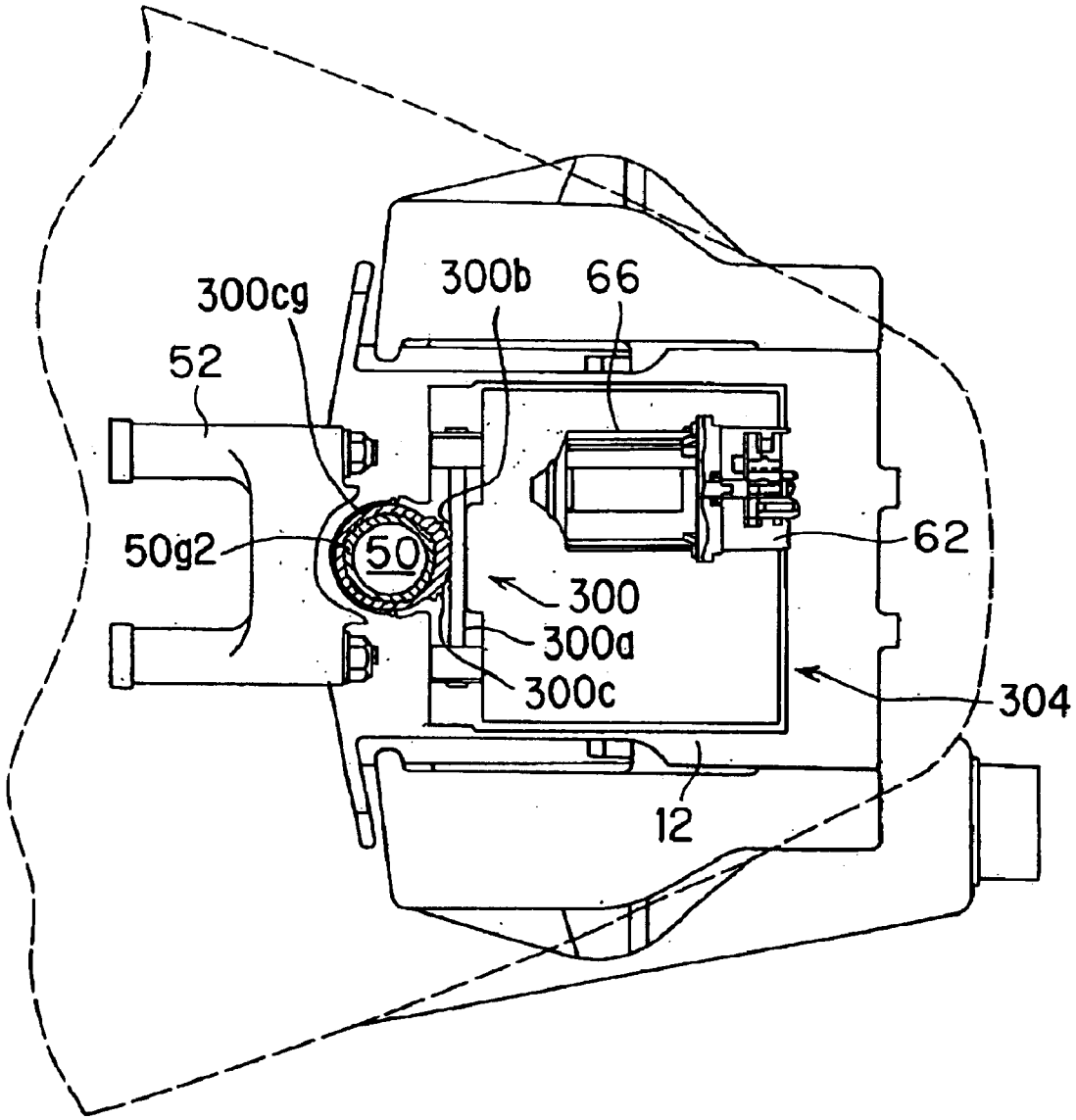
FIG. 16 is a cross-sectional view taken along the line XVI—XVI of FIG. 15.

FIG. 16 is a cross-sectional view taken along XVI—XVI line of FIG. 15.

As shown in FIGS. 15 and 16, the rotary piston motor (hereinafter referred to as the "piston motor") 300 is housed in the swivel case 12 at a position near the lower end of the swivel shaft 50. Specifically, the piston motor 300 has a piston rod 300*a*, a rack 300*b* fastened to the piston rod 300*a* and a pinion (gear) 300*c* to be meshed with the rack 300*b*. The piston motor 300 is located around the swivel shaft 50 in such a manner that a rotation axis of the pinion 300*c* is coaxial with the rotation axis of the swivel shaft 50. More specifically, the pinion 300*c* has an inner toothed gear 300*cg* that meshes with a spur gear 50*g*2 formed around the swivel shaft 50.

With this, the swivel shaft 50 is rotated when the pinion 300*c* of the piston motor 300 is rotated. In other words, the swivel shaft 50 is directly rotated by the rotation of the pinion 300*c* of the piston motor 300, without interposing any medium such as a link mechanism therebetween.

As illustrated in the figures, the swivel case 12 is enlarged at its top and in the interior space formed there, there is housed and fixed a hydraulic pressure supplier comprising the hydraulic pump 62 that supplies hydraulic pressure to the piston motor 300, a hydraulic circuit 304 (only partially shown) that connects the hydraulic pump 62 to the piston motor 300, and the electric motor 66 that drives the hydraulic pump 62.

When the operator steers the steering wheel 28, the amount of steering is detected by the steering angle sensor 30 and is inputted to the ECU 22. The ECU 22 determines or calculates the current supply command in response to the inputted amount of steering and outputs the same to the driver circuit of the electric motor 66 through harness 98 to drive the hydraulic pump 62 such that the pinion 300*c* of the piston motor 300 is rotated. The rotation of the pinion 300*c* resulting in therefrom is transmitted to the swivel shaft 50 through the gears 300*cg* and 50*g*2. Thus, by operating the piston motor 300, the steering of the outboard motor 10 in the horizontal direction about the rotation of the swivel shaft 50 is power-assisted and the propeller 24 (and the rudder 26) is swung to steer the boat 16.

Next, the hydraulic circuit 304 (that connects the hydraulic pump 62 to the piston motor 300, etc.) will be explained with reference to FIG. 17.

Figure 17:
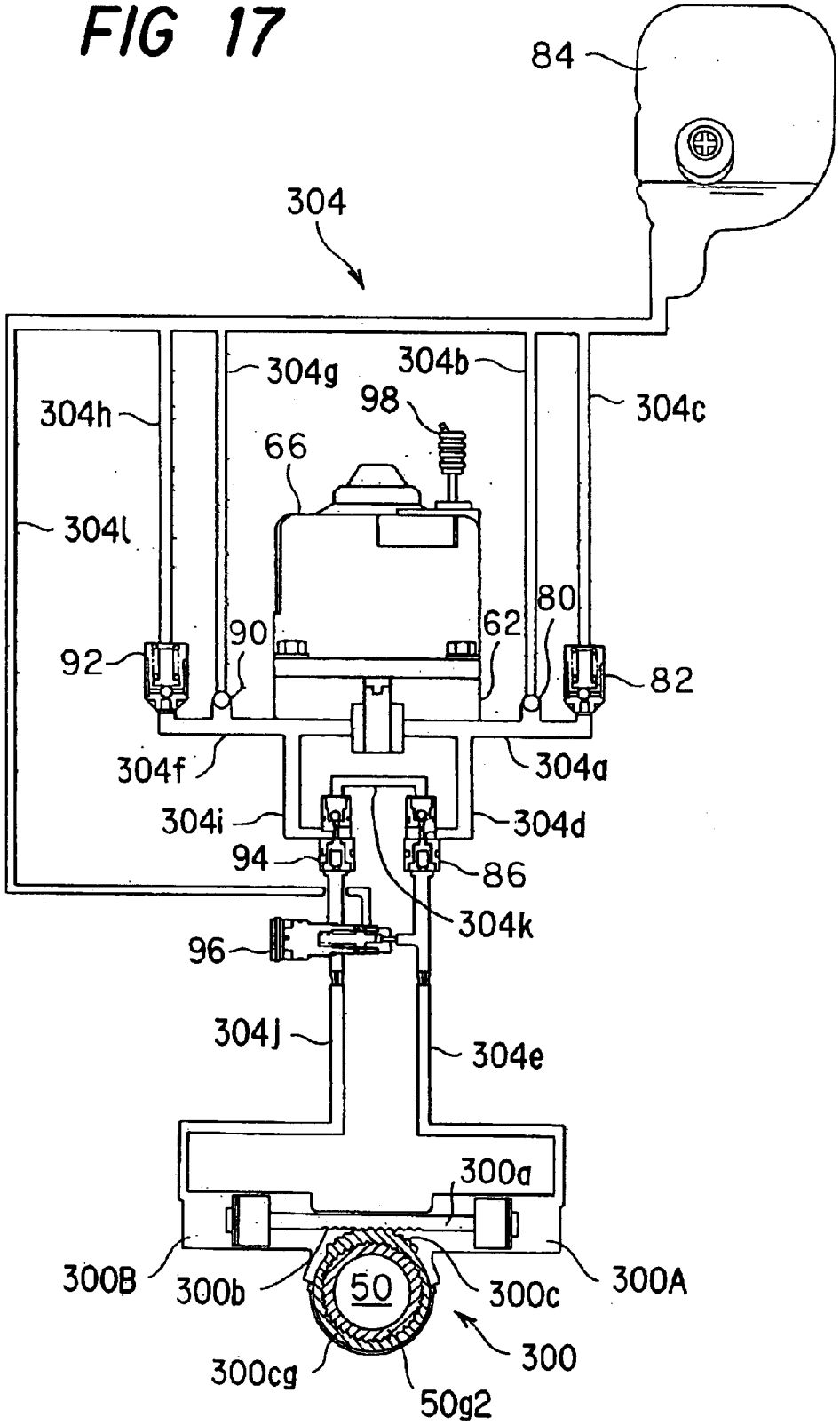
FIG. 17 is a circuit diagram of a hydraulic circuit showing the operation of a hydraulic pressure supplier that supplies hydraulic pressure to a rotary piston motor illustrated in FIG. 16.

FIG. 17 is a circuit diagram showing the hydraulic circuit 304.

Explaining this with emphasis on the differences from the hydraulic circuits in the foregoing embodiments, the first switch valve 86 is connected, at its primary side, to an oil path 304*d*, and is, connected, at its secondary side, to a first oil chamber 300A of the piston motor 300 through an oil path 304*e*. The second switch valve 94 is connected, at its primary side, to an oil path 304*i*, and is connected, at its secondary side, to a second oil chamber 300B of the piston motor 300 through an oil path 304*j*.

Thus, the outboard motor steering system according to the fourth embodiment comprises the piston motor 300 (that rotate the swivel shaft 50 which acts as the steering shaft of the outboard motor 10), the hydraulic pressure supplier (for supplying hydraulic pressure to the piston motor 300), and the controller, i.e., the ECU 22 that controls the operation of the hydraulic pressure supplier. Among of them, the piston motor 300 and the hydraulic pressure supplier (that supplies hydraulic pressure thereto) are housed in the swivel case 12.

The operation of the hydraulic pressure supplier will then be explained with reference to FIG. 17.

When the ECU 22 is inputted with the amount of steering indicating that the outboard motor 10 is to be steered left to turn the boat 16 right, the ECU 22 calculates the current supply command and supplies it to the electric motor 66 such that it operates the hydraulic pump 62 discharges or pumps pressurized oil in an oil path 304*a*. When the hydraulic pump 62 is operated in this manner, oil reserved in the tank 84 flows along the line of the oil path 304*g*, the second check valve 90, the oil path 304*f*, the pump 62, the oil path 304*a* and an oil path 304*d*, and is supplied to the first switch valve 86, and then flows in the first oil chamber 300A of the piston motor 300.

When the pressurized oil whose pressure is equal to or greater than the predetermined pressure acts on the pilot side of the second switch valve 94 through an oil path 304*k*, the second switch valve 94 connects the oil path 304*j* to the oil path 304*i* such that the pressurized oil in the second oil chamber 300B flows out. With this, the piston rod 300*a* of the piston motor 300 is swung right relative to the boat 16, and the pinion 300*c* rotates left through the rack 300*b* to rotate the swivel shaft 50 in the same direction, thereby enabling the outboard motor 10 to be steered left.

On the other hand, when the ECU 22 is inputted with the amount of steering indicating that the outboard motor 10 is to be steered right to turn the boat 16 left, the ECU 22 calculates the current supply command and supplies it to the electric motor 66 to rotate in the opposite direction, i.e., it operates the hydraulic pump 62 discharges the pressurized oil in the oil path 304*f*. As a result, the oil reserved in the tank 84 flows along the line of the oil path 304*b*, the first check valve 80, the oil path 304*a*, the pump 62, the oil path 304*f* and the oil path 304*i*, and is supplied to the second switch valve 94.

With this, the second switch valve 94 connects the oil path 304*i* to the oil path 304*j* such that the pressurized oil flows in the second oil chamber 300B of the piston motor 300. When the pressurized oil whose pressure is equal to or greater than the predetermined pressure acts on the pilot side of the first switch valve 86 through an oil path 304*k*, the first switch valve 86 connects the oil path 304*e* to the oil path 304*d* such that the pressurized oil flow out from the first oil chamber 300A. With this, the piston rod 300*a* of the piston motor 300 is rotated left relative to the boat 16, and the pinion 300*c* rotates right through the rack 300*b* to rotate the swivel shaft 50 in the same direction, thereby enabling the outboard motor 10 to be steered right.

As stated above, the outboard motor steering system according to the fourth embodiment is arranged such that piston motor 300 that rotate the swivel shaft 50 acting as the steering shaft of the outboard motor 10, and the hydraulic pressure supplier that supplies the hydraulic pressure to the piston motor 300 are housed in the swivel case 12. Since the steering system is completed inside of the outboard motor 10, this add-on system can make the structure simple and can avoid increase in number of components and weight.

Further, since the piston motor 300 is installed around the swivel shaft 50 in such a manner that the rotation axis of the pinion 300*c* is coaxial with the rotation axis of the swivel shaft 50 in such a manner that the swivel shaft 50 is directly driven by the piston motor 300, this can decrease the number of parts and can further make the structure simpler, thereby enabling to avoid degradation of operation efficiency in fabrication and maintenance. Further, since there is no moving part, this can eliminate occurrence of play and can further improve the steering response and steering feel.

Further, by setting the gear ratio of the rack 300*b* and the pinion 300*c*, it becomes possible to achieve a desired steering (driving) speed and a desired torque. Since the rotation axis of the pinion 300*c* is coaxial with that of the swivel shaft 50, the distance from the swivel shaft 50 to the piston motor 300 can be shortened. This can increase the freedom of designing the height of the location of the piston motor 300. In other words, it becomes possible to locate the piston motor 300 at a desired position.

Further, it is arranged such that the right or left steering is conducted by directly rotating the swivel shaft by the rotation of the piston motor 300, the driving speed and torque in the right steering and left steering is made equal to each other, thereby enabling to avoid occurrence of difference in the driving (i.e., the steering angle and angular speed).

Further, since the hydraulic pressure supplier comprises the hydraulic pump 62 that supplies the hydraulic pressure to the piston motor 300, the hydraulic circuit 304 that connects the motor 300 to the pump 62, and the electric motor 66 that drives the hydraulic pump 62, this can eliminate a hydraulic hose or adapter and some similar factors to be installed on the boat 16, thereby enabling further space-saving. Since there is no fear that oil leaks from the hose or adapter, this can improve reliance of the system. Since the hydraulic pressure supplier is covered in the swivel case 12, its component such as the electric motor 66 can be protected from seawater and dust, enabling to further enhance the reliance of the system.

It should be noted in the above, although the ECU 22 is housed inside the engine cover 20 near the engine 18, the ECU 22 may be housed in the swivel case 12 together with the piston motor 300 and the hydraulic pressure supplier.

It should also be noted that, although the piston motor 300 is housed in the swivel case 12 at the position near the lower end of the swivel shaft 50, the location of the vane motor 300 should not be limited thereto and may be located at any position in the swivel case 12 such as at a midway position or at an upper position of the swivel shaft 50.

An outboard motor steering system according to a fifth embodiment of the invention will now be explained with reference to FIG. 18 and FIG. 19.

Figure 18:
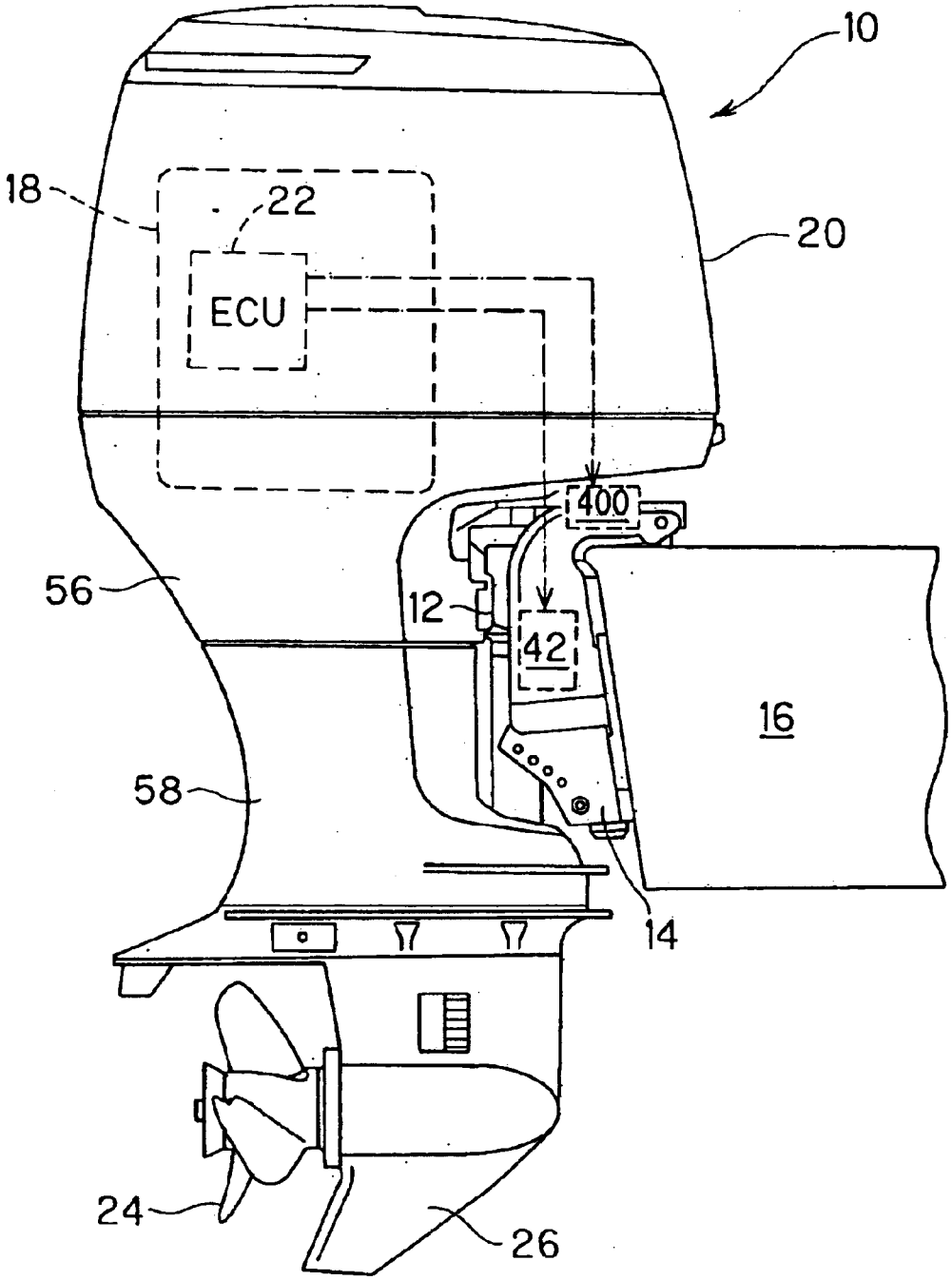
FIG. 18 is a view, similar to FIG. 2, but showing an outboard motor steering system according to a fifth embodiment of the invention.
Figure 19:
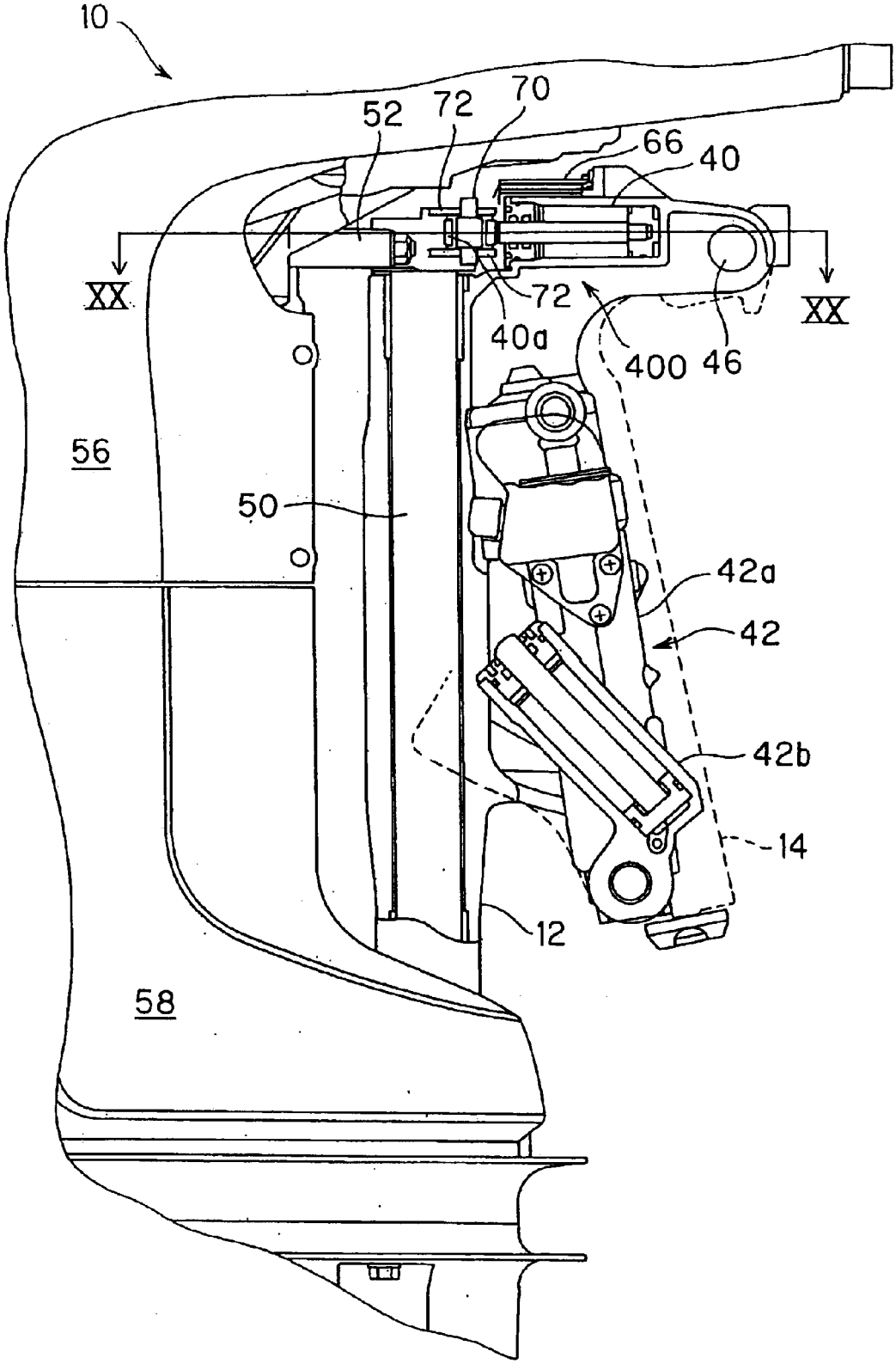
FIG. 19 is a view, similar to FIG. 3, but showing the outboard motor steering system according to the fifth embodiment.

FIG. 18 and FIG. 19 are views, similar to FIG. 2 and FIG. 3, but showing the outboard motor steering system according to the fifth embodiment of the invention. The same reference numerals in these figures and on indicate the same elements used in the first embodiment.

Explaining the fifth embodiment with emphasis on the differences from the foregoing embodiments, in the fifth embodiment, the hydraulic cylinder (double-acting cylinder) 40 and the hydraulic pressure supplier (comprising the hydraulic pump 62, the hydraulic circuit 64 and the electric motor 66, etc.) used in the first embodiment are combined together as a unit 400, and the unit 400 is housed inside the swivel case 12 to rotate the swivel shaft 50.

Figure 20:
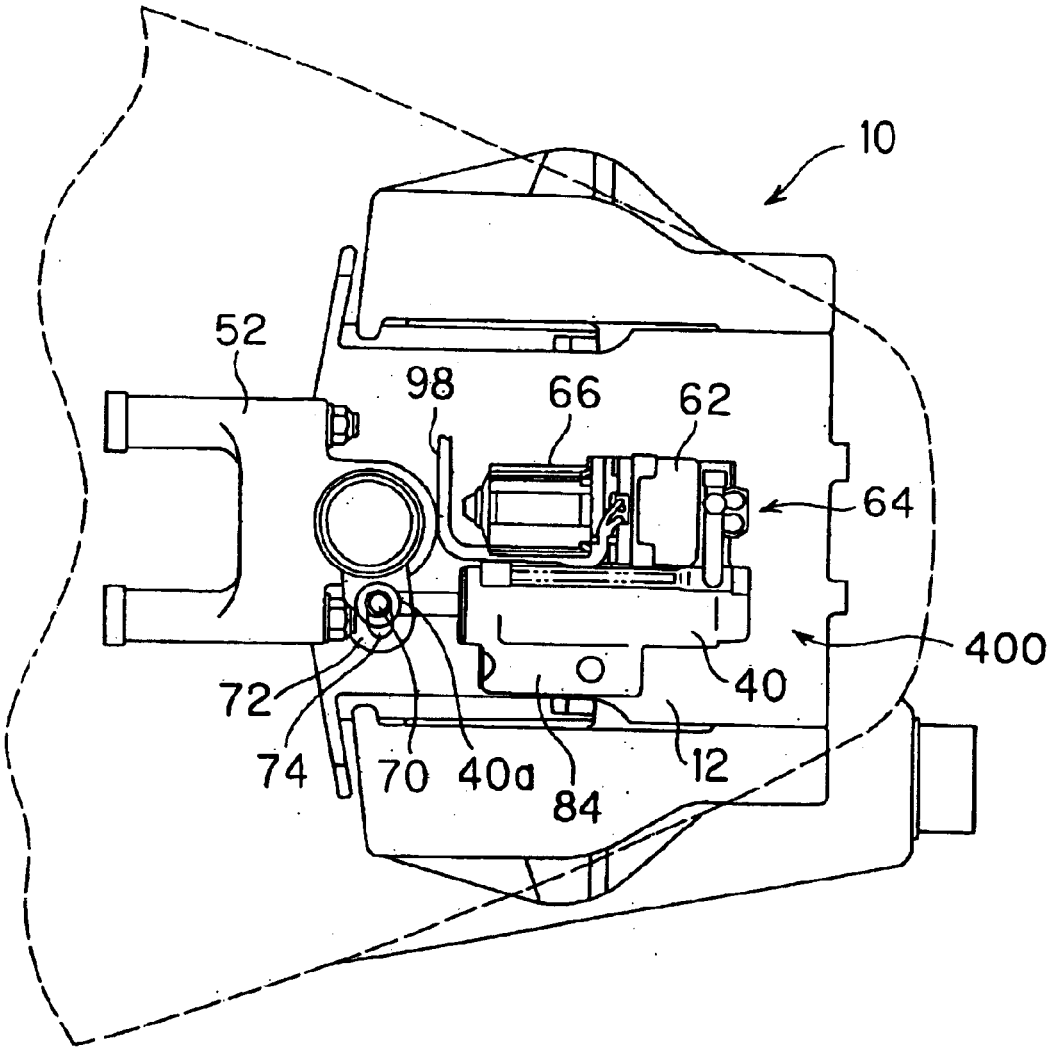
FIG. 20 is a cross-sectional view taken along the line XX—XX of FIG. 19.

FIG. 20 is a cross-sectional view taken along XX—XX line of FIG. 19.

As shown in FIGS. 19 and 20, the swivel case 12 is enlarged at its upper portion and the unit 400 is housed and fixed there. As best shown in FIG. 20, in the unit 400, the hydraulic cylinder (double-acting cylinder) 40 and the electric motor 66 are arranged such that their longitudinal axes are in parallel with each other.

As stated above, the outboard motor steering system according to the fifth embodiment is arranged such that the hydraulic cylinder (double-acting cylinder) 40 that rotates the swivel shaft 50 acting as the steering shaft of the outboard motor 10, and the hydraulic pressure supplier are combined together as the unit 400 in such a manner that the unit is housed in the outboard motor 10, more precisely in the swivel case 12. Since the steering system is completed inside of the outboard motor 10, this add-on system can make the structure simple and can avoid increase in number of components and weight. And since the steering system is completed inside of the outboard motor 10, it can save space on the boat 16 and can avoid degradation of operation efficiency in fabrication and maintenance.

Further, since the system can eliminate a hydraulic hose or adapter and some similar factors to be installed on the boat 16, thereby enabling further space-saving. Since there is no fear that oil leaks from the hose or adapter, this can improve reliance of the system. Since the unit is covered in the swivel case 12, its component such as the electric motor 66 can be protected from seawater and dust, enabling to further enhance the reliance of the system.

Further, since the hydraulic cylinder (double-acting cylinder) 40 and the electric motor 66 are arranged in such a way that their longitudinal directions are in parallel with each other, this can allow them to be installed in a compact manner, thereby enabling to further space-saving.

It should be noted in the above that, although the ECU 22 is located within the engine cover 20 near the engine 18, it may be located in the swivel case 12 together with the unit 400 or inside the unit 400.

It should also be noted in the above that, although hydraulic cylinder (double-acting cylinder) 40 is used, it is alternatively possible to use the hydraulic cylinder (single-acting cylinder) 100 or other actuators mentioned in the second to the fourth embodiments.

The first to fifth embodiments are thus arranged to have a steering system for an outboard motor 10 mounted on a stern of a boat 16 and having an internal combustion engine 18 at its upper portion and a propeller 24 with a rudder 26 at its lower portion that is powered by the engine to propel and steer the boat, comprising: a swivel shaft 50 connected to the propeller to turn the propeller relative to the boat; a swivel case 12 that is fixed to the outboard motor and roratably houses the swivel shaft; a hydraulic actuator (double-acting cylinder 40, single-acting cylinders 100, vane motor 200, piston motor 300) that is connected to the swivel shaft to rotate the swivel shaft; a hydraulic pressure supplier that is connected to the hydraulic actuator to supply hydraulic pressure to the hydraulic actuator; and a controller (ECU 22) that is connected to the hydraulic pressure supplier to control supply of the hydraulic pressure to the hydraulic actuator in response to a steering signal inputted by an operator such that the outboard motor is steered relative to the boat; wherein at least the hydraulic actuator and the hydraulic pressure supplier are housed in the swivel case.

In the system, the hydraulic actuator comprises a double-acting cylinder 40 whose one end is connected to the swivel shaft 50 and whose other end is fixed to the swivel case 12 such that the outboard motor is steered relative to the boat. The one end of the double-acting cylinder is connected to the swivel shaft through a mount frame 52 fixed to the swivel shaft. The hydraulic pressure supplier comprises at least a hydraulic pump 62 that produces the hydraulic pressure to be supplied to the double-acting cylinder, a hydraulic circuit 64 that connects the hydraulic pump to the double-acting cylinder, and an electric motor 66 that drives the hydraulic pump. The double-acting cylinder 40 and the electric motor 66 are arranged such that their longitudinal axes are in parallel with each other.

In the system, the hydraulic actuator comprises single-acting cylinders 100 whose each one end is connected to the swivel shaft and whose each other end is fixed to the swivel case such that the outboard motor is steered relative to the boat. The each one end of the single-acting cylinders 100 is connected to the swivel shaft 50 through a mount frame 52 fixed to the swivel shaft 50. The single-acting cylinders are each connected to the mount frame through a (corresponding) contact 114 fastened to a (corresponding) stay 112 that is fixed to the mount frame 52. The hydraulic pressure supplier comprises at least a hydraulic pump 62 that produces the hydraulic pressure to be supplied to the single-acting cylinders 100, a hydraulic circuit 104 that connects the hydraulic pump to the single-acting cylinders, and an electric motor 66 that drives the hydraulic pump.

In the system, the hydraulic actuator comprises a vane motor 200 whose one end is connected to the swivel shaft 50 and whose other end is fixed to the swivel case 12 such that the outboard motor is steered relative to the boat. The vane motor has a vane 200*a* and is arranged around the swivel shaft 50 in such a manner that a rotation axis of the vane is coaxial with that of the swivel shaft. The vane is connected to the swivel shaft through gears 200*ag,* 50*g*. The hydraulic pressure supplier comprises at least a hydraulic pump 62 that produces the hydraulic pressure to be supplied to the vane motor, a hydraulic circuit 204 that connects the hydraulic pump to the vane motor, and an electric motor 66 that drives the hydraulic pump.

In the system, the hydraulic actuator comprises a piston motor 300 whose one end is connected to the swivel shaft and whose other end is fixed to the swivel case such that the outboard motor is steered relative to the boat. The piston motor has a pinion 300*c* and is connected to the swivel shaft in such a manner that a rotation axis of the pinion is coaxial with that of the swivel shaft. The pinion is connected to the swivel shaft through gears 300*cg,* 50*g*2. The hydraulic pressure supplier comprises at least a hydraulic pump 62 that produces the hydraulic pressure to be supplied to the piston motor, a hydraulic circuit 304 that connects the hydraulic pump to the piston motor, and an electric motor 66 that drives the hydraulic pump.

In the system, at least the hydraulic actuator and the hydraulic pressure supplier are housed in the swivel case as a unit 400. The hydraulic pressure supplier comprises at least a hydraulic pump 62 that produces the hydraulic pressure to be supplied to the hydraulic actuator such as the double-acting cylinder 40, a hydraulic circuit 64 that connects the hydraulic pump to the hydraulic actuator, and an electric motor 66 that drives the hydraulic pump. The hydraulic circuit includes at least a relief valve 82, 92 that avoids excessive oil pressure increase, a switch valve 86, 94 that switches a direction of oil flow, a tank 84 that reserves oil, oil paths 64*a*–64*l* along which oil flows, a manual valve 96 that connects the hydraulic actuator to the tank through the operator's manual operation.

The entire disclosure of Japanese Patent Application Nos. 2002-363828, 2002-363829,2002-363830, 2002-363831 and 2002-363832, all filed on Dec. 16, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for an outboard motor mounted on a stern of a boat and having an internal combustion engine at its upper portion and a propeller with a rudder at its lower portion that is powered by the engine to propel and steer the boat, comprising:

a swivel shaft connected to the propeller to turn the propeller relative to the boat;

a swivel case that is fixed to the outboard motor and rotatably houses the swivel shaft;

a hydraulic actuator that is connected to the swivel shaft to rotate the swivel shaft;

a hydraulic pressure supplier that is connected to the hydraulic actuator to supply hydraulic pressure to the hydraulic actuator; and a controller that is connected to the hydraulic pressure supplier to control supply of the hydraulic pressure to the hydraulic actuator in response to a steering signal inputted by an operator such that the outboard motor is steered relative to the boat;

wherein at least the hydraulic actuator and the hydraulic pressure supplier are housed in the swivel case.

2. A system according to claim 1, wherein the hydraulic actuator comprises a double-acting cylinder whose one end is connected to the swivel shaft and whose other end is fixed to the swivel case such that the outboard motor is steered relative to the boat.

3. A system according to claim 2, wherein the one end of the double-acting cylinder is connected to the swivel shaft through a mount frame fixed to the swivel shaft.

4. A system according to claim 2, wherein the hydraulic pressure supplier comprises at least a hydraulic pump that produces the hydraulic pressure to be supplied to the double-acting cylinder, a hydraulic circuit that connects the hydraulic pump to the double-acting cylinder, and an electric motor that drives the hydraulic pump.

5. A system according to claim 4, wherein the double-acting cylinder and the electric motor are arranged such that their longitudinal axes are in parallel with each other.

6. A system according to claim 1, wherein the hydraulic actuator comprises single-acting cylinders whose each one end is connected to the swivel shaft and whose each other end is fixed to the swivel case such that the outboard motor is steered relative to the boat.

7. A system according to claim 6, wherein the each one end of the single-acting cylinders is connected to the swivel shaft through a mount frame fixed to the swivel shaft.

8. A system according to claim 7, wherein the single-acting cylinders are each connected to the mount frame through a contact fastened to a stay that is fixed to the mount frame.

9. A system according to claim 6, wherein the hydraulic pressure supplier comprises at least a hydraulic pump that produces the hydraulic pressure to be supplied to the single-acting cylinders, a hydraulic circuit that connects the hydraulic pump to the single-acting cylinders, and an electric motor that drives the hydraulic pump.

10. A system according to claim 1, wherein the hydraulic actuator comprises a vane motor whose one end is connected to the swivel shaft and whose other end is fixed to the swivel case such that the outboard motor is steered relative to the boat.

11. A system according to claim 10, wherein the vane motor has a vane and is arranged around the swivel shaft in such a manner that a rotation axis of the vane is coaxial with that of the swivel shaft.

12. A system according to claim 11, wherein the vane is connected to the swivel shaft through gears.

13. A system according to claim 10, wherein the hydraulic pressure supplier comprises at least a hydraulic pump that produces the hydraulic pressure to be supplied to the vane motor, a hydraulic circuit that connects the hydraulic pump to the vane motor, and an electric motor that drives the hydraulic pump.

14. A system according to claim 1, wherein the hydraulic actuator comprises a piston motor whose one end is connected to the swivel shaft and whose other end is fixed to the swivel case such that the outboard motor is steered relative to the boat.

15. A system according to claim 14, wherein the piston motor has a pinion and is connected to the swivel shaft in such a manner that a rotation axis of the pinion is coaxial with that of the swivel shaft.

16. A system according to claim 15, wherein the pinion is connected to the swivel shaft through gears.

17. A system according to claim 14, wherein the hydraulic pressure supplier comprises at least a hydraulic pump that produces the hydraulic pressure to be supplied to the piston motor, a hydraulic circuit that connects the hydraulic pump to the piston motor, and an electric motor that drives the hydraulic pump.

18. A system according to claim 1, wherein at least the hydraulic actuator and the hydraulic pressure supplier are housed in the swivel case as a unit.

19. A system according to claim 18, wherein the hydraulic pressure supplier comprises at least a hydraulic pump that produces the hydraulic pressure to be supplied to the hydraulic actuator, a hydraulic circuit that connects the hydraulic pump to the hydraulic actuator, and an electric motor that drives the hydraulic pump.

20. A system according to claim 19, wherein the hydraulic circuit includes at least a relief valve that avoids excessive oil pressure increase, a switch valve that switches a direction of oil flow, a tank that reserves oil, oil paths along which oil flows, a manual valve that connects the hydraulic actuator to the tank through the operator's manual operation.

* * * * *